US007642219B2

(12) United States Patent
Odaka et al.

(10) Patent No.: US 7,642,219 B2
(45) Date of Patent: Jan. 5, 2010

(54) THERMAL TRANSFER SHEET

(75) Inventors: Tsuaki Odaka, Shinjuku-Ku (JP); Munenori Ieshige, Shinjuku-Ku (JP); Mitsuru Maeda, Shinjuku-Ku (JP); Kenichi Hirota, Shinjuku-Ku (JP); Masahiro Yuki, Shinjuku-Ku (JP)

(73) Assignee: Dai Nippon Printing Co., Ltd., Shinjuku-Ku (JP)

( * ) Notice: Subject to any disclaimer, the term of this patent is extended or adjusted under 35 U.S.C. 154(b) by 179 days.

(21) Appl. No.: 10/586,171

(22) PCT Filed: Jan. 20, 2005

(86) PCT No.: PCT/JP2005/000700

§ 371 (c)(1),
(2), (4) Date: Jul. 17, 2006

(87) PCT Pub. No.: WO2005/068210

PCT Pub. Date: Jul. 28, 2005

(65) Prior Publication Data

US 2008/0069982 A1 Mar. 20, 2008

(30) Foreign Application Priority Data

| | | |
|---|---|---|
| Jan. 20, 2004 | (JP) | 2004-011610 |
| Mar. 1, 2004 | (JP) | 2004-055681 |
| Mar. 1, 2004 | (JP) | 2004-055682 |
| Mar. 12, 2004 | (JP) | 2004-070969 |
| Mar. 25, 2004 | (JP) | 2004-089716 |

(51) Int. Cl.
*B41M 5/50* (2006.01)
*B41M 5/42* (2006.01)

(52) U.S. Cl. ..... 503/227; 428/32.81

(58) Field of Classification Search ..... None
See application file for complete search history.

(56) References Cited

U.S. PATENT DOCUMENTS

| | | | |
|---|---|---|---|
| 3,216,983 | A | 11/1965 | Shelanski et al. |
| 5,106,217 | A | 4/1992 | Mecke et al. |
| 5,147,843 | A | 9/1992 | Bodem et al. |
| 5,306,691 | A | 4/1994 | Bauer et al. |
| 2003/0181331 | A1 | 9/2003 | Ieshige et al. |

FOREIGN PATENT DOCUMENTS

| | | | |
|---|---|---|---|
| JP | 02-074375 | A1 | 3/1990 |
| JP | 05-131760 | A1 | 5/1993 |
| JP | 07-179072 | A1 | 7/1995 |
| JP | 2002-274046 | A1 | 9/2002 |
| JP | 2003-312151 | | 11/2003 |
| JP | 2003-312151 | A1 | 11/2003 |
| JP | 2004-074766 | A1 | 3/2004 |

*Primary Examiner*—Bruce H Hess
(74) *Attorney, Agent, or Firm*—Burr & Brown

(57) ABSTRACT

Disclosed is a thermal transfer sheet that can meet demands for increased printing speed in thermal transfer, higher density of thermally transferred images, and higher quality. The thermal transfer sheet comprises a substrate and an adhesive layer and a dye layer provided in that order on one side of the substrate, wherein the adhesive layer comprises a polyvinylpyrrolidone resin and a composition for suppressing hygroscopic properties of the polyvinylpyrrolidone resin.

16 Claims, 1 Drawing Sheet

THERMAL TRANSFER SHEET

CROSS-REFERENCE TO RELATED APPLICATIONS

This patent application is based on Japanese Patent Application No. 011610/2004, Japanese Patent Application No. 055681/2004, Japanese Patent Application No. 055682/2004, Japanese Patent Application No. 070969/2004, and Japanese Patent Application No. 089716/2004, and the contents of these prior applications are incorporated herein by reference.

BACKGROUND OF THE INVENTION

1. Field of the Invention

The present invention relates to a thermal transfer sheet comprising a substrate, an adhesive layer, and a dye layer.

2. Background Art

Various thermal transfer recording methods have hitherto been known in the art. Among others, a method for forming various full-color images using dyes for dye sublimation transfer as recording materials has been proposed. In this method, a thermal transfer sheet comprising dye layers formed by holding, by a suitable binder, dyes as recording materials on a substrate such as a polyester film is provided, and the sublimable dyes are thermally transferred from the thermal transfer sheet onto a thermal transfer image-receiving sheet comprising a dye-receptive layer provided on an object dyeable with a sublimable dye, for example, paper or plastic film to form a full-color image. In this case, a large number of color dots of three or four colors with the quantity of heat being regulated are transferred by heating by means of a thermal head as heating means in a printer onto a receptive layer in the thermal transfer image-receiving sheet to reproduce a full color of an original by the multicolor dots. In this method, since coloring materials used are dyes, the formed images are very sharp and are highly transparent and thus are excellent in reproduction of intermediate colors and in gradation and are comparable with images formed by conventional offset printing or gravure printing. At the same time, this method can form high-quality images comparable with full-color images formed by photography.

In the thermal transfer recording method utilizing the thermal dye sublimation transfer, it has been pointed out that an increase in printing speed of thermal transfer printers has posed a problem that conventional thermal transfer sheets cannot provide satisfactory print density. Further, high density and high sharpness have become required of prints of images formed by thermal transfer. To meet this demand, various attempts have been made to improve thermal transfer sheets and thermal transfer image-receiving sheets which receive sublimable dyes transferred from the thermal transfer sheets to form images. For example, an attempt to improve the sensitivity in transfer at the time of printing has been made by reducing the thickness of the thermal transfer sheet. In this case, however, in a few cases, upon the application of heat, pressure or the like in the production of the thermal transfer sheet, cockles often occur. Further, in thermal transfer recording, in a few cases, cockling in prints or breaking of the thermal transfer sheet occurs.

Further, an attempt to improve the print density and the sensitivity in transfer at the time of printing has been made by increasing the dye/binder ratio in the dye layer of the thermal transfer sheet. In this case, however, during storage in a wound state, the dye is transferred onto the heat-resistant slip layer provided on the backside of the thermal transfer sheet, and, at the time of rewinding, the dyes transferred onto the heat-resistant slip layer are retransferred onto dye layers of other colors or the like. That is, a kick back phenomenon occurs. When the contaminated dye layers are thermally transferred onto an image-receiving sheet, hue different from a designated one is provided, that is, the so-called "smudge" occurs. Further, in the image formation by thermal transfer, when high energy is applied in a thermal transfer printer, fusing of the dye layer to the receptive layer, that is, the so-called "abnormal transfer," is likely to occur. A large amount of a release agent can be added to the receptive layer for abnormal transfer prevention purposes. However, it has been found that the addition of a large amount of the release agent causes blurring, smudge and other unfavorable phenomena of the image.

On the other hand, patent document 1 (Japanese Patent Publication No. 102746/1995) proposes a thermal transfer sheet wherein a hydrophilic barrier/subbing layer comprising polyvinylpyrrolidone as a main component and, mixed with the main component, polyvinyl alcohol as a component for enhancing dye transfer efficiency is provided between a dye layer and a support. The polyvinylpyrrolidone is used for preventing abnormal transfer and preventing sticking at the time of printing and the polyviny alcohol functions to improve the sensitivity in transfer. In patent document 1, there is no specific teaching about an improvement in sensitivity in transfer by polyvinylpyrrolidone.

Patent document 2 (Japanese Patent Laid-Open No. 312151/2003) proposes a thermal transfer sheet that can realize an enhancement in sensitivity in the thermal transfer and can suppress abnormal transfer by using a polyvinylpyrrolidone-containing primer layer for a dye layer. As a result of a confirmative examination by the present inventors, however, it was found that, in this thermal transfer sheet, due to hygroscopicity by polyvinylpyrrolidone, particularly under high temperature and high humidity conditions, the adhesion of the primer layer is deteriorated and, at the time of thermal transfer, the dye layer is transferred in a layer form onto the image receptive layer in the image receiving sheet, or otherwise the separation and transfer, in a layer form, of the receptive layer onto the dye layer side, which are considered as derived from mixing of the primer layer with the dye layer, disadvantageously take place.

On the other hand, patent document 3 (Japanese Patent Laid-Open No. 312151/2003) proposes a thermal transfer sheet, developed by the present inventors, comprising an adhesive layer formed of a polyvinylpyrrolidone resin provided between a dye layer and a support. This thermal transfer sheet is advantageous in that the adhesive layer can enhance the efficiency of dye transfer onto the image receiving sheet to improve the print density and, at the time of printing, fusing to the image receiving sheet and abnormal transfer can also be suppressed. However, printing under a severe environment such as high humidity and use of an image receiving sheet having low releasability after long-term storage of this thermal transfer sheet comprising this adhesive layer under a high humidity environment such as an environment of 40° C. and 90% have sometimes caused fusing between the thermal transfer sheet and the image receiving sheet and abnormal transfer.

Accordingly, even when the thermal transfer printer and thermal transfer recording materials for the thermal transfer sheet and the thermal transfer image receiving sheet are regulated for meeting requirements for increased printing speed of the thermal transfer, increased density of thermally transferred images and higher quality, unfavorable phenomena take place including that no satisfactory print density can be provided and abnormal transfer occurs at the time of thermal transfer, making it impossible to provide printed matter having satisfactory quality. Accordingly, at the present time, the development of a thermal transfer sheet, which can meet requirements for increased printing speed of the thermal transfer, increased density of thermally transferred images and higher quality, and, at the same time, can produce printed matter having satisfactory quality, has been desired.

[Patent document 1] Japanese Patent Publication No. 102746/1995

[Patent document 2] Japanese Patent Laid-Open No. 312151/2003

[Patent document 3] Japanese Patent Laid-Open No. 312151/2003

SUMMARY OF THE INVENTION

At the time of the invention of the present invention, the present inventors have found that a thermal transfer sheet comprising an adhesive layer, which comprises a modified polyvinylpyrrolidone resin or a combination of a polyvinylpyrrolidone resin with an additive, can satisfactorily meet requirements, for example, for increased printing speed in thermal transfer, increased density of thermally transferred images, and higher quality, and, at the same time, can improve the sensitivity in transfer in printing and can effectively prevent unfavorable phenomena such as the occurrence of abnormal transfer and cockling even under a severe printing environment for example, under a high temperature and high humidity environment. The present invention has been made based on such finding.

Accordingly, the present invention is to provide a thermal transfer sheet that can satisfactorily meet requirements for increased printing speed in thermal transfer, increased density of thermally transferred images, and higher quality, and, at the same time, can produce high-quality printed matter.

These objects can be attained by the following first to five aspects of the present invention.

First Aspect of the Present Invention

The thermal transfer sheet according to the first aspect of the present invention comprises: a substrate; a heat resistant slip layer; an adhesive layer; and a dye layer, wherein said heat resistant slip layer is provided on one side of said substrate, said adhesive layer and said dye layer are provided in that order on the other side of said substrate, and said adhesive layer comprises a modified polyvinylpyrrolidone resin.

According to the thermal transfer sheet in the first aspect of the present invention, the adhesive layer comprises a modified polyvinylpyrrolidone resin. Accordingly, the adhesion between the dye layer and the substrate can be enhanced, for example, even under a high temperature and high humidity environment, and the occurrence of unfavorable phenomena such as abnormal transfer can be prevented. At the same time, in the thermal transfer, the sensitivity in transfer can be significantly improved, and high-density thermally transferred images can be provided without the application of high energy.

Second Aspect of the Present Invention

The thermal transfer sheet in second aspect of the present invention comprises: a substrate; a heat resistant slip layer; an adhesive layer; and a dye layer, wherein said heat resistant slip layer is provided on one side of said substrate, said adhesive layer and said dye layer are provided in that order on the other side of said substrate, and said adhesive layer comprises a polyvinylpyrrolidone resin and a saccharide or a sugar alcohol.

According to the thermal transfer sheet in the second aspect of the present invention, the adhesive layer comprises a polyvinylpyrrolidone resin and a saccharide or a sugar alcohol, and the saccharide or sugar alcohol can suppress the hygroscopic properties of the polyvinylpyrrolidone resin. As a result, the thermal transfer sheet according to the present invention can enhance the adhesion between the dye layer and the substrate even under a high temperature and high humidity environment, can prevent abnormal transfer and the like. At the same time, in the thermal transfer, the sensitivity in transfer can be significantly improved, and high-density thermal transfer images can be produced even without the application of high energy.

Third Aspect of the Present Invention

The thermal transfer sheet according to the third aspect of the present invention comprises: a substrate; a heat resistant slip layer; an adhesive layer; and a dye layer, wherein said heat resistant slip layer is provided on one side of said substrate, said adhesive layer and said dye layer are provided in that order on the other side of said substrate, and said adhesive layer comprises a polyvinylpyrrolidone resin and a complex forming agent.

In the thermal transfer sheet according to the third aspect of the present invention, by virtue of the presence of a polyvinylpyrrolidone resin and a complex forming agent in the adhesive layer, the polyvinylpyrrolidone resin is bonded to the complex forming agent to form a polyvinylpyrrolidone complex (composite) which does not dissolve in water, resulting in the prevention of the development of hygroscopic properties. As a result, the thermal transfer sheet according to the present invention can enhance the adhesion between the dye layer and the substrate even under a high temperature and high humidity environment, can prevent abnormal transfer and the like, and, at the same time, in the thermal transfer, can significantly improve the sensitivity in transfer and can produce high-density thermally transferred images without the application of high energy.

Fourth Aspect of the Present Invention

The thermal transfer sheet according to the fourth aspect of the present invention comprises: a substrate; a heat resistant slip layer; an adhesive layer; and a dye layer, wherein said heat resistant slip layer is provided on one side of said substrate, said adhesive layer and said dye layer are provided in that order on the other side of said substrate, and said adhesive layer comprises a polyvinylpyrrolidone resin and a modifying agent for modifying said resin.

According to the thermal transfer sheet in the fourth aspect of the present invention, since the adhesive layer comprises a polyvinylpyrrolidone resin and a modifying agent for modifying the resin, the hygroscopic properties of the polyvinylpyrrolidone resin can be suppressed. As a result, the thermal transfer sheet according to the present invention can enhance the adhesion between the dye layer and the substrate even under a high temperature and high humidity environment, can prevent abnormal transfer and the like. At the same time, in the thermal transfer, the sensitivity in transfer can be significantly improved, and high-density thermal transfer images can be produced even without the application of high energy.

Fifth Aspect of the Present Invention

The thermal transfer sheet according to the fifth aspect of the present invention comprises: a substrate; and an adhesive layer and a dye layer provided in that order on at least one side of the substrate, wherein said adhesive layer comprises a polyvinylpyrrolidone resin, (A) at least one component selected from the group consisting of polyurethane resins and acrylic polyol resins that are soluble in a mixed solvent composed of methyl ethyl ketone and isopropyl alcohol at a weight ratio of 1:1 and, even when diluted to a solid content of 5% by weight, do not gel, and (B) at least one component selected from the group consisting of isocyanates, blocked isocyanates, and aluminum chelating agents that are soluble in a mixed solvent composed of methyl ethyl ketone and isopropyl alcohol at a weight ratio of 1:1 and, even when diluted to a solid content of 5% by weight, do not gel.

According to the thermal transfer sheet in the fifth aspect of the present invention, since the adhesive layer comprises a polyvinylpyrrolidone resin and at least one component selected from the group (A) and the group (B), the hygroscopic properties of the polyvinylpyrrolidone resin can be suppressed. As a result, the thermal transfer sheet according to the present invention can enhance the adhesion between the dye layer and the substrate even under a high temperature and high humidity environment, can prevent abnormal transfer, heat fusing and the like. At the same time, in the thermal transfer, the sensitivity in transfer can be significantly improved, and high-density thermal transfer images can be produced even without the application of high energy.

BEST MODE FOR CARRYING OUT THE INVENTION

Thermal Transfer Sheet

Figure 1:
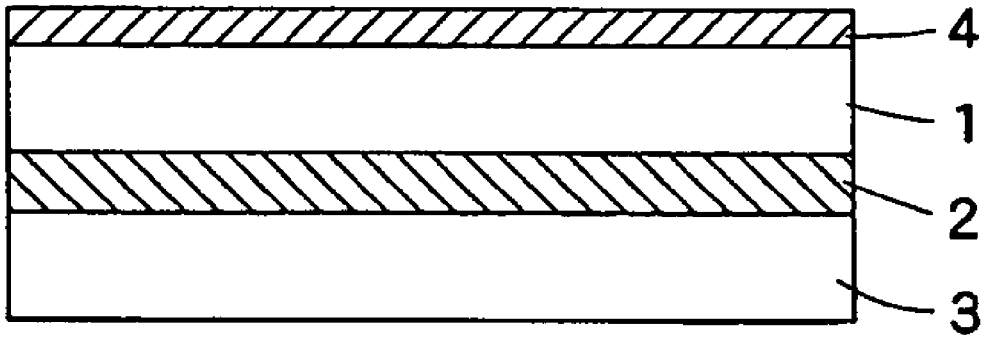
FIG. 1 is a schematic cross-sectional view showing one embodiment of thermal transfer sheets according to first to fifth aspects of the present invention.

Thermal transfer sheets according to the first to fourth aspects of the present invention will be described with reference to FIG. 1. FIG. 1 is a schematic cross-sectional view of the thermal transfer sheet according to the present invention. In the thermal transfer sheet shown in FIG. 1, a heat resistant slip layer 4, which functions to improve the slipperiness of a thermal head and to prevent sticking, is provided on one side of the substrate 1. An adhesive layer 2 comprising a specific composition of a straight chain polymer, and a dye layer 3 are provided in that order on the other side of the substrate 1. In the thermal transfer sheet according to the fifth aspect of the present invention, the provision of the heat resistant slip layer 4 may be omitted. In the thermal transfer sheets according to the other aspects of the present invention, as with the first aspect of the present invention, the heat resistant slip layer 4 may be provided.

Figure 2:
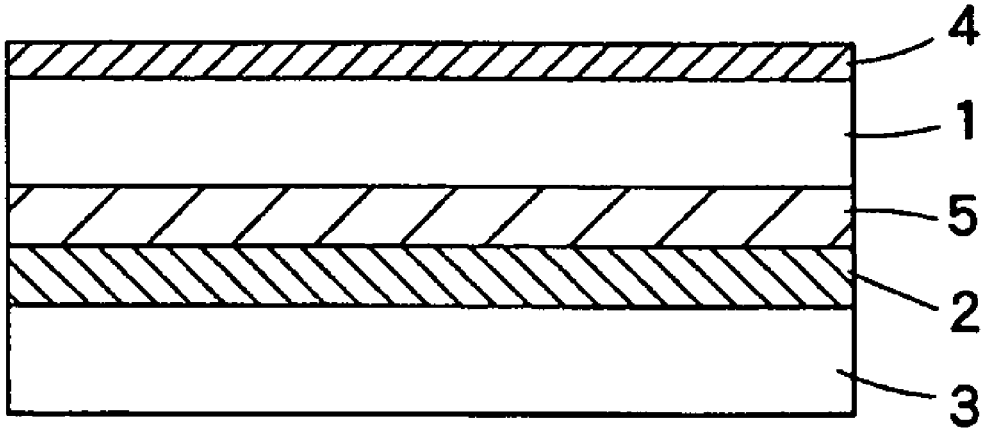
FIG. 2 is a schematic cross-sectional view showing one embodiment of thermal transfer sheets according to first to fifth aspects of the present invention.

Another embodiment of thermal transfer sheets according to the first to fifth aspects of the present invention will be described with reference to FIG. 2. FIG. 2 is a schematic cross-sectional view of the thermal transfer sheet according to the present invention. In the thermal transfer sheet shown in FIG. 2, a heat resistant slip layer 4, which functions to improve the slipperiness of a thermal head and to prevent sticking, is provided on one side of the substrate 1. A primer layer 5 comprising a specific composition of a straight chain polymer, an adhesive layer 2, and a dye layer 3 are provided in that order on the other side of the substrate 1.

First Aspect of the Present Invention

1. Adhesive Layer

The adhesive layer according to the first aspect of the present invention comprises a modified polyvinylpyrrolidone resin. Since the modified polyvinylpyrrolidone resin per se is antihygroscopic, the hygroscopic properties of the thermal transfer sheet used under high humidity conditions can be significantly suppressed. Therefore, as compared with an adhesive layer formed of a polyvinylpyrrolidone resin alone, the adhesion between the dye layer and the substrate under high temperature and high humidity conditions can be improved.

The adhesive layer comprises a modified polyvinylpyrrolidone. The modified polyvinylpyrrolidone resin is a copolymer of an N-vinylpyrrolidone monomer with other monomer. The N-vinylpyrrolidone monomer mainly refers to N-vinylpyrrolidone, such as N-vinyl-2-pyrrolidone and N-vinyl-4-pyrrolidone, and its derivatives. Specific examples of such derivatives include compounds having a substituent in the pyrrolidone ring, for example, N-vinyl-3-methylpyrrolidone, N-vinyl-5-methylpyrrolidone, N-vinyl-3,3,5-trimethylpyrrolione, and N-vinyl-3-benzylpyrrolidone. The copolymerization method is not particularly limited, and example of polymerization methods include random copolymerization, block copolymerization, and graft copolymerization.

A vinyl polymerizable monomer may be mentioned as the monomer component copolymerizable with the N-vinylpyrrolidone monomer. Specific examples of vinyl polymerizable monomers include (meth)acrylic monomers such as (meth) acrylic acid, methyl (meth)acrylate, ethyl (meth)acrylate, and isopropyl (meth)acrylate, unsaturated carboxylic acids such as fumaric acid, maleic acid, and itaconic acid, ethylene, propylene, vinyl chloride, vinyl acetate, vinyl alcohol, styrene, vinyltoluene, divinylbenzene, vinylidene chloride, ethylene tetrafluoride, and vinylidene fluoride. In the present invention, since a copolymer of vinyl acetate or styrene monomer with the N-vinylpyrrolidone monomer is antihygroscopic, the adhesion between the dye layer and the substrate can be advantageously improved even under a high temperature and high humidity environment. The modified polyvinylpyrrolidone resin may be synthesized by using an N-vinylpyrrolidone monomer component and other comonomer component at a molar ratio of about 10% to 80% (N-vinylpyrrolidone monomer component/N-vinylpyrrolidone monomer component+other comonomer component).

The addition amount of the modified polyvinylpyrrolidone resin is preferably 10% by weight to 50% by weight based on the total solid content of the component for adhesive layer formation. When the addition amount falls within the above-defined range, as compared with an adhesive layer formed of only a polyvinylpyrrolidone resin as a straight chain polymer, the adhesion between the dye layer and the substrate under high temperature and high humidity conditions can be enhanced and, consequently, for example, abnormal transfer at the time of thermal transfer of the thermal transfer sheet can be significantly prevented.

The adhesive layer may further comprise other resins. Specific examples of other resins include polyvinylpyrrolidone resins, polyvinyl alcohol resins, and cellulose derivatives. Specific examples of polyvinylpyrrolidone resins include homopolymers of vinylpyrrolidones such as N-vinyl-2-pyrrolidone and N-vinyl-4-pyrrolidone, or copolymers of thereof. In particular, polyvinylpyrrolidone resins as a straight chain polymer are preferred because the effect of improving the sensitivity in transfer in printing is high and, at the same time, the adhesive between the dye layer and the substrate is good. Preferably, the polyvinylpyrrolidone resin has a K value in a Fickencher's formula of not less than 60, and grades of K-60 to K-120 are particularly preferred. When the polyvinylpyrrolidone resin has a K value of not less than 60, the sensitivity in transfer in printing can be advantageously improved. The polyvinylpyrrolidone resin may have a number average molecular weight of about 30,000 to 280,000.

Formation of Adhesive Layer

The adhesive layer may be formed by optionally adding an additive to a modified polyvinylpyrrolidone resin (preferably a modified polyvinylpyrrolidone resin mixed with a straight chain polyvinylpyrrolidone resin), dissolving or dispersing the resin in water or an aqueous solvent such as alcohols or an organic solvent to prepare a coating liquid and coating the coating liquid onto a substrate by conventional coating means such as gravure printing, screen printing, or reverse roll coating using a gravure plate. The coverage of the component for forming the adhesive layer (coating liquid) is about 0.01 to 0.3 g/m$^2$, preferably 0.05 to 0.15 g/m$^2$, on a dry basis. When the coverage is in the above-defined range, the concaves and convexes on the substrate can be eliminated by filling with the coating to form an even surface, that is, no uncoated part occurs. As a result, an abnormal transfer phenomenon that, in the thermal transfer, the dye layer is disadvantageously transferred onto the receptive layer side of the image receiving sheet, can be effectively prevented. Further, mixing of the adhesive layer with the dye layer at the time of coating of the dye layer can be prevented, and, thus, in the thermal transfer, abnormal transfer of the receptive layer onto the dye layer side can be effectively prevented.

2. Substrate

The substrate may be any material so far as it has a certain level of heat resistance and strength. For example, polyethylene terephthalate films, 1,4-polycyclohexylene dimethylene terephthalate films, polyethylene naphthalate films, polyphenylene sulfide films, polystyrene films, polypropylene films, polysulfone films, aramid films, polycarbonate films, polyvinyl alcohol films, cellophane, cellulose derivatives such as cellulose acetate, polyethylene films, polyvinyl chloride films, nylon films, polyimide films, and ionomer films may be mentioned as specific examples of such substrates. The thickness of the substrate is 0.5 to 50 μm, preferably about 1 to 10 μm.

In the present invention, in forming an adhesive layer on the substrate according to the present invention, when the adhesive layer has satisfactory adhesion to the substrate, the adhesive layer can be provided directly on the substrate without adhesion treatment of the substrate. For example, an adhesive component can be added to the adhesive layer to enhance the adhesion to the substrate.

In the present invention, however, adhesion treatment can be carried out on the substrate in its surface where the adhesive layer and the dye layer are formed. When the substrate is formed of a plastic film, this adhesion treatment is particularly preferred because, when an adhesive layer is formed by coating on the substrate, the wetting properties, adhesion and the like of the coating liquid can be improved. Conventional resin surface modification techniques such as corona discharge treatment, flame treatment, ozone treatment, ultraviolet treatment, radiation treatment, roughening treatment, chemical agent treatment, plasma treatment, low-temperature plasma treatment, primer treatment, and grafting treatment may be applied as the adhesion treatment. A combination of two or more of these treatment methods may also be used. The primer treatment may be carried out, for example, by coating, in melt extrusion of a plastic film to form a film, a primer liquid onto an unstretched film and then subjecting the assembly to stretching treatment.

Primer Layer

The adhesion treatment can be carried out by coating a primer layer between the substrate and the adhesive layer. The primer layer may be formed of a resin, and examples of such resins include polyester resins, polyacrylic ester resins, polyvinyl acetate resins, polyurethane resins, styrene acrylate resins, polyacrylamide resins, polyamide resins, polyether resins, polystyrene resins, polyethylene resins, polypropylene resins, vinyl resins such as polyvinyl chloride resins and polyvinyl alcohol resins, and polyvinyl acetoacetal resins such as polyvinylacetoacetal and polyvinylbutyral.

3. Dye Layer

The dye layer may be formed as a single layer of one color, or alternatively may be formed as a plurality of layers containing dyes with different hues. The dye layer may be formed repeatedly in a face serial manner on an identical plane of the identical substrate. The dye layer is a layer comprising a thermally transferable dye supported by any desired binder. Dyes, which are thermally melted, diffused or transferred by sublimation, are usable in the dye layer, and any dye used in conventional dye sublimation thermal transfer sheets may be used. The dye may be properly selected by taking into consideration, for example, hue, sensitivity in printing, lightfastness, storage stability, and solubility in binders.

Specific examples of dyes include: diarylmethane dyes; triarylmethane dyes; thiazole dyes; methine dyes such as merocyanine dyes and pyrazolone methine dyes; azomethine dyes typified by indoaniline dyes, acetophenoneazomethine dyes, pyrazoloazomethine dyes, imidazoleazomethine dyes, imidazoazomethine dyes, and pyridoneazomethine dyes; xanthene dyes; oxazine dyes; cyanomethylene dyes typified by dicyanostyrene dyes and tricyanostyrene dyes; thiazine dyes; azine dyes; acridine dyes; azo dyes such as benzeneazo dyes, pyridoneazo dyes, thiopheneazo dyes, isothiazoleazo dyes, pyrroleazo dyes, pyrraleazo dyes, imidazoleazo dyes, thiadiazoleazo dyes, triazoleazo dyes, and disazo dyes; spiropyran dyes; indolinospiropyran dyes; fluoran dyes; rhodaminelactam dyes; naphthoquinone dyes; anthraquinone dyes; and quinophthalone dyes.

In forming the dye layer, a binder may be added to a composition (a liquid composition) for dye layer formation, and, for example, a conventional resin binder may be used. Specific examples of preferred binders (resins) include: cellulosic resins such as ethylcellulose, hydroxyethylcellulose, ethylhydroxycellulose, hydroxypropylcellulose, methylcellulose, cellulose acetate, and cellulose butyrate; vinyl resins such as polyvinyl alcohol, polyvinyl acetate, polyvinyl butyral, polyvinyl acetal, polyvinylpyrrolidone, and polyacrylamide; polyester resins; and phenoxy resins. Among them, cellulosic resins, acetal resins, butyral resins, polyester resins, phenoxy resins and the like are particularly preferred, for example, from the viewpoints of heat resistance and transferability of dye.

Further, in the present invention, instead of the resin (binder), the following releasable graft copolymers may be used as a release agent or a binder. The releasable graft copolymers are such that at least one releasable segment selected from a polysiloxane segment, a carbon fluoride segment, a hydrocarbon fluoride segment, and a long-chain alkyl segment has been graft polymerized to the main chain of a polymer. Among them, a graft copolymer produced by grafting a polysiloxane segment onto the main chain of a polyvinyl acetal resin is particularly preferred.

The dye layer may comprise the above dye, the binder, and optionally other various additives. For example, organic fine particles, such as polyethylene wax, and inorganic fine particles may be mentioned as additives for improving the separability of the thermal transfer sheet from the image-receiving sheet and the coatability of the ink.

Formation of Dye Layer

In general, the dye layer may be formed by adding the dye, the binder, and optional additives to a suitable solvent to dissolve or disperse the ingredients and thus to prepare a liquid composition, coating the liquid composition onto a substrate, and drying the coating. Conventional coating means, such as gravure printing, screen printing, and reverse roll coating using a gravure plate, may be used for the coating. The coverage of the component for forming the dye layer (coating liquid) is 0.2 to 6.0 g/m$^2$, preferably about 0.3 to 3.0 g/m$^2$, on a dry basis.

4. Heat-Resistant Slip Layer

In the thermal transfer sheet according to the present invention, a heat resistant slip layer is provided mainly from the viewpoint of preventing adverse effects such as sticking caused by heat of a thermal head and cockling at the time of printing.

The heat resistant slip layer may be formed using a resin. Examples of resins usable herein include polyvinyl butyral resins, polyvinyl acetoacetal resins, polyester resins, vinyl chloride-vinyl acetate copolymers, polyether resins, polybutadiene resins, styrene-butadiene copolymers, acrylic polyols, polyurethane acrylates, polyester acrylates, polyether acrylates, epoxy acrylates, prepolymers of urethane or epoxy, nitrocellulose resins, cellulose nitrate resins, cellulose acetopropionate resins, cellulose acetate butyrate resins, cellulose acetate hydrodiene phthalate resins, cellulose acetate resins, aromatic polyamide resins, polyimide resins, polyamide-imide resins, polycarbonate resins, and chlorinated polyolefin resins.

The heat resistant slip layer may also be formed by adding a slipperiness-imparting agent to the resin, or by top-coating a slipperiness-imparting agent to the heat resistant slip layer formed of a resin. Specific examples of slipperiness-imparting agents include phosphoric esters, silicone oils, graphite powder, silicone graft polymers, fluoro graft polymers, acrylsilicone graft polymers, acrylsiloxanes, arylsiloxanes, and other silicone polymers. A preferred slipperiness-imparting agent comprises a polyol, for example, a high-molecular polyalcohol compound, a polyisocyanate compound and a phosphoric ester compound. In the present invention, the addition of a filler is more preferred.

The heat-resistant slip layer may be formed by dissolving or dispersing the resin, the slipperiness-imparting agent, and a filler in a suitable solvent to prepare a liquid composition for a heat resistant slip layer, coating the liquid composition onto the substrate sheet by forming means, such as gravure printing, screen printing, or reverse roll coating using a gravure plate, and drying the coating. The coverage of the heat-resistant slip layer is preferably 0.1 to 3.0 g/m$^2$ on a solid basis.

Second Aspect of the Present Invention

The thermal transfer sheet according to the second aspect of the present invention has the same construction as the thermal transfer sheet according to the first aspect of the present invention, except for the adhesive layer. That is, for example, the substrate, the primer layer, the heat resistant slip layer, and the dye layer may be the same as those in the thermal transfer sheet according to the first aspect of the present invention.

Adhesive Layer

The adhesive layer in the second aspect of the present invention comprises a polyvinylpyrrolidone resin and a saccharide or a sugar alcohol. Since the saccharide or sugar alcohol is highly hygroscopic, the saccharide or sugar alcohol absorbs moisture and the moisture absorption of the polyvinylpyrrolidone resin can be significantly suppressed. Therefore, as compared with an adhesive layer formed of a polyvinylpyrrolidone resin alone, the adhesion between the dye layer and the substrate under high temperature and high humidity conditions can be improved, and abnormal transfer can be significantly suppressed.

1) Polyvinylpyrrolidone Resin

Specific examples of polyvinylpyrrolidone resins include homopolymers of vinylpyrrolidones such as N-vinyl-2-pyrrolidone and N-vinyl-4-pyrrolidone, or copolymers of thereof. In particular, polyvinylpyrrolidone resins as a straight chain polymer are preferred because the effect of improving the sensitivity in transfer in printing is high and, at the same time, the adhesive between the dye layer and the substrate is good. Preferably, the polyvinylpyrrolidone resin has a K value in a Fickencher's formula of not less than 60, and grades of K-60 to K-120 are particularly preferred. When the polyvinylpyrrolidone resin has a K value of not less than 60, the sensitivity in transfer in printing can be advantageously improved. The polyvinylpyrrolidone resin may have a number average molecular weight of about 30,000 to 280,000.

Polyvinylpyrrolidone resins may be polymers comprising not only a monomer of N-vinyl-2-pyrrolidone or N-vinyl-4-pyrrolidone but also a derivative having a substituent in a pyrrolidone ring such as N-vinyl-3-methylpyrrolidone, N-vinyl-5-methylpyrrolidone, N-vinyl-3,3,5-trimethylpyrrolidone, or N-vinyl-3-benzylpyrrolidone. The adhesive layer may further comprise other resin (binder), and specific examples of other resins include polyvinyl alcohol resins and cellulose derivatives.

The addition amount of the polyvinylpyrrolidone resin is preferably about 95% by weight to 85% by weight based on the total solid content of the component for forming the adhesive layer.

2) Saccharide or Sugar Alcohol

Specific examples of saccharides include sucrose, lactose, fructose, maltose, isomaltose, maltose, maltoligosaccharide, maltodextrin, fructo-oligosaccharide, isomerized sugar, coupling sugar, galacto-oligosaccharide, and polydextrose. Specific examples of sugar alcohol include xylitol, erythritol, sortibol, mannitol, lactitol, isomaltitol, hydrogenated glucose syrup, xylo-oligosaccharide alcohol, and polydextrose reducing substance. Two or more saccharides or sugar alcohols may be used in combination. In the present invention, among the saccharides or sugar alcohols, xylitol is preferred. The adhesive layer comprising xylitol can effectively improve the adhesion between the substrate and the dye layer at room temperature or under high humidity conditions.

The addition amount of the saccharide or sugar alcohol is preferably 5% by weight to 10% by weight based on the total solid content of the adhesive layer. When the addition amount falls within the above-defined range, the adhesion between the dye layer and the substrate under high temperature and high humidity conditions can be enhanced and, consequently, unfavorable phenomena such as abnormal transfer can be prevented.

Formation of Adhesive Layer

The adhesive layer may be formed by dissolving or dispersing a polyvinylpyrrolidone resin, a saccharide or a sugar alcohol, and optionally an additive in water, an aqueous solvents such as alcohols, or an organic solvent to prepare a coating liquid and coating the coating liquid onto a substrate by conventional coating means such as gravure printing, screen printing, or reverse roll coating using a gravure plate. The coverage of the component for forming the adhesive layer (coating liquid) is about 0.05 to 0.3 g/m$^2$ on a dry basis. When the coverage is in the above-defined range, the concaves and convexes on the substrate can be eliminated by filling with the coating to form an even surface, that is, no uncoated part occurs. As a result, an abnormal transfer phenomenon that, in the thermal transfer, the dye layer is disadvantageously transferred onto the receptive layer side of the image receiving sheet, can be effectively prevented. Further, mixing of the adhesive layer with the dye layer at the time of coating of the dye layer can be prevented, and, thus, in the thermal transfer, abnormal transfer of the receptive layer onto the dye layer side can be effectively prevented.

Third Aspect of the Present Invention

The thermal transfer sheet according to the third aspect of the present invention has the same construction as the thermal transfer sheet according to the first aspect of the present invention, except for the adhesive layer. That is, for example, the substrate, the primer layer, the heat resistant slip layer, and the dye layer may be the same as those in the thermal transfer sheet according to the first aspect of the present invention.

Adhesive Layer

The adhesive layer in the third aspect of the present invention comprises a polyvinylpyrrolidone resin and a complex forming agent. When a complex forming agent is added to the polyvinylpyrrolidone resin, the complex forming agent is bonded to the polyvinylpyrrolidone resin to from a complex of polyvinylpyrrolidone (composite). This complex (composite) is insoluble in water, and the hygroscopicity is lost. Therefore, the hygroscopic properties of the polyvinylpyrrolidone resin can be suppressed, and the hygroscopic properties of the thermal transfer sheet used under high humidity conditions can be significantly suppressed. By virtue of this, as compared with an adhesive layer formed of a polyvinylpyrrolidone resin alone, the adhesion between the dye layer and the substrate under high temperature and high humidity conditions can be improved and the abnormal transfer can be significantly suppressed.

1) Polyvinylpyrrolidone Resin

Details of the polyvinylpyrrolidone resin may be the same as those described above in connection with the second aspect of the present invention. The addition amount of the polyvinylpyrrolidone resin is preferably 99.5% by weight to 850% by weight based on the total solid content of the component for forming the adhesive layer.

2) Complex Forming Agent

The complex forming agent is added as a molecule to the end of polyvinylpyrrolidone to form a complex. The resultant complex removes the water absorption of the polyvinylpyrrolidone resin and thus can render the polyvinylpyrrolidone insoluble in water. Specific examples of complex forming agents include polyacrylic acid, tannic acid, and phenols such as resorcin and pyrogallol. The "tannic acid" generally refers to tannins obtained from nutgalls or galls. Tannins are classified into two groups, hydrolyzable tannins and condensed tannins. Hydrolyzable tannins are a group of pyrogallol tannins that are hydrolyzed with an acid, an alkali or an enzyme (tannase) into an alcohol (generally glucose) and an acid (generally gallic acid). Typical hydrolyzable tannins include gall tannins and gallnut tannins. Hydrolyzable gall and gallnut tannins are preferably used. Regarding the "pyrogallol," not only pyrogallol per se but also pyrogallol derivatives such as pyrogallol ether, pyrogallol ester, and gallic esters may also be used. Two or more of the above complex forming agents may be used in combination so far as there is no influence of interaction between the two or more complex forming agents. In the present invention, among the above complex forming agents, hydrolysable tannins and pyrogallol derivatives are preferred.

Regarding the adhesion between the substrate and the dye layer, good adhesion can be provided both at room temperature and under high humidity conditions. In the present invention, in order to prevent a deterioration in adhesion between the dye layer and the substrate due to the moisture absorption of the polyvinylpyrrolidone resin in the adhesive layer, the polyvinylpyrrolidone resin is bonded to the complex forming agent to form a complex of polyvinylpyrrolidone (composite) insoluble in water, thus rendering the polyvinylpyrrolidone nonhygroscopic. Consequently, by virtue of the copresence of the polyvinylpyrrolidone resin and the complex in the adhesive layer, the adhesion between the dye layer and the substrate can be enhanced even under a high temperature and high humidity environment, and unfavorable phenomena such as abnormal transfer can be prevented.

The addition amount of the complex forming agent is preferably 0.5% by weight to 10% by weight based on the total solid content of the component for forming the adhesive layer. When the addition amount falls within the above-defined range, the adhesion between the dye layer and the substrate under high temperature and high humidity conditions can be improved.

Formation of Adhesive Layer

The adhesive layer may be formed by mixing a polyvinylpyrrolidone resin with a complex forming agent, optionally adding additives to the mixture, and dissolving or dispersing the mixture in water, an aqueous solvent of alcohols, or an organic solvent to prepare a coating liquid, and coating the coating liquid by conventional coating means such as gravure printing, screen printing, or reverse roll coating using a gravure plate. The coverage of the adhesive layer is 0.05 to 0.3 g/m$^2$ on a dry basis. When the coverage is in the above-defined range, the concaves and convexes on the substrate can be eliminated by filling with the coating to form an even surface, that is, no uncoated part occurs. As a result, an abnormal transfer phenomenon that, in the thermal transfer, the dye layer is disadvantageously transferred onto the receptive layer side of the image receiving sheet, can be effectively prevented. Further, mixing of the adhesive layer with the dye layer at the time of coating of the dye layer can be prevented, and, thus, in the thermal transfer, abnormal transfer of the receptive layer onto the dye layer side can be effectively prevented.

Fourth Aspect of the Present Invention

The thermal transfer sheet according to the fourth aspect of the present invention has the same construction as the thermal transfer sheet according to the first aspect of the present invention, except for the adhesive layer. That is, for example, the substrate, the primer layer, the heat resistant slip layer, and the dye layer may be the same as those in the thermal transfer sheet according to the first aspect of the present invention.

Adhesive Layer

The adhesive layer in the fourth aspect of the present invention comprises a polyvinylpyrrolidone resin and a modifying agent for modifying the resin. The addition of the modifying agent to the polyvinylpyrrolidone resin can suppress the hygroscopic properties of the polyvinylpyrrolidone resin and can significantly suppress the hygroscopic properties of the thermal transfer sheet under high humidity conditions. By virtue of this, as compared with an adhesive layer formed of a polyvinylpyrrolidone resin alone, the adhesion between the dye layer and the substrate under high temperature and high humidity conditions can be improved and the abnormal transfer can be significantly suppressed.

1) Polyvinylpyrrolidone Resin

Details of the polyvinylpyrrolidone resin may be the same as those described above in connection with the second aspect of the present invention. The addition amount of the polyvinylpyrrolidone resin is preferably 99.5% by weight to 85% by weight based on the total solid content of the component for forming the adhesive layer.

2) Modifying Agent

The modifying agent modifies the polyvinylpyrrolidone resin per se. The addition of the modifying agent can suppress the hygroscopic properties of the polyvinylpyrrolidone resin per se and can significantly improve the adhesion to the substrate. Specific examples of modifying agents usable herein include carboxymethylcellulose, cellulose acetate, cellulose acetate propionate, dibutyl tartrate, dimethyl phthalate, shellac resins and other resins. Preferred are cellulose acetate propionate and shellac resins. In the present invention, two or more of the above modifying agents may be used in combination.

The addition amount of the modifying agent is preferably 0.5% by weight to 10% by weight based on the total solid content of the component for forming the adhesive layer. When the addition amount falls within the above-defined range, the adhesion between the dye layer and the substrate under high temperature and high humidity conditions can be improved, and the abnormal transfer can be significantly suppressed.

Formation of Adhesive Layer

The adhesive layer may be formed by mixing a polyvinylpyrrolidone resin with a modifying agent, optionally adding additives to the mixture, dissolving or dispersing the mixture in water, an aqueous solvents such as alcohols, or an organic solvent to prepare a coating liquid and coating the coating liquid onto a substrate by conventional coating means such as gravure printing, screen printing, or reverse roll coating using a gravure plate. The coverage of the adhesive layer is about 0.05 to 0.3 $g/m^2$ on a dry basis. When the coverage is in the above-defined range, the concaves and convexes on the substrate can be eliminated by filling with the coating to form an even surface, that is, no uncoated part occurs. As a result, an abnormal transfer phenomenon that, in the thermal transfer, the dye layer is disadvantageously transferred onto the receptive layer side of the image receiving sheet, can be effectively prevented. Further, mixing of the adhesive layer with the dye layer at the time of coating of the dye layer can be prevented, and, thus, in the thermal transfer, abnormal transfer of the receptive layer onto the dye layer side can be effectively prevented.

Fifth Aspect of the Present Invention

The thermal transfer sheet according to the fifth aspect of the present invention has the same construction as the thermal transfer sheet according to the first aspect of the present invention, except for the adhesive layer. That is, for example, the substrate, the primer layer and the dye layer may be the same as those in the thermal transfer sheet according to the first aspect of the present invention. Further, in the fifth aspect of the present invention, as with the first aspect of the present invention, a heat resistant slip layer may be formed. In this case, the construction and formation of the heat resistant slip layer may be as described above in connection with the first aspect of the present invention.

Adhesive Layer

The adhesive layer according to the fifth aspect of the present invention comprises a polyvinylpyrrolidone resin and at least one component selected from the group (A) and at least one component selected from the group (B). The addition of at least one component selected from the group (A) and at least one component selected from the group (B) to the polyvinylpyrrolidone resin can suppress the hygroscopic properties of the polyvinylpyrrolidone resin and can significantly suppress the hygroscopic properties of the thermal transfer sheet used under high humidity conditions. Therefore, as compared with an adhesive layer formed of a polyvinylpyrrolidone alone, the adhesion between the dye layer and the substrate under high temperature and high humidity conditions can be improved, and the abnormal transfer can be significantly suppressed. In particular, when a mixture of a polyurethane resin and/or an acrylic polyol resin in the group (A) with an isocyanate, a blocked isocyanate and/or an aluminum chelating agent in the group (B) is added, the polyurethane resin and acrylic polyol resin in the group (A) are cured. Therefore, a significant level of improvement in adhesive strength and water resistance of the thermal transfer sheet can be realized, and abnormal transfer in high energy printing can be suppressed.

1) Polyvinylpyrrolidone Resin

Specific examples of polyvinylpyrrolidone resins include homopolymers of vinylpyrrolidones such as N-vinyl-2-pyrrolidone and N-vinyl-4-pyrrolidone, or copolymers of thereof. The polyvinylpyrrolidone resin suitable for use in the present invention has a molecular weight in the range of 1000 to 3500 ($\times 10^3$) as measured by GPC and has a K value in a Fickencher's formula in the range of 80 to 130.

In an embodiment of the present invention, a modification product of a polyvinylpyrrolidone resin may be contained in combination with the polyvinylpyrrolidone resin. In this case, one of the modification products of polyvinylpyrrolidone used is a copolymer of vinylpyrrolidone with other copolymerizable monomer. The modification product is added from the viewpoint of lowering the water absorption of a coating film of polyvinylpyrrolidone to suppress a lowering in adhesion under a high temperature and high humidity environment. Copolymerizable monomers include, for example, vinyl monomers such as styrene, vinyl acetate, acrylic esters, acrylonitrile, maleic anhydride, vinyl chloride (fluoride), and vinylidene chloride (fluoride or cyanide). A copolymer produced by radical copolymerization of the vinyl monomer with vinylpyrrolidone may be used. Further, block copolymers and graft copolymers between resins, such as polyester, polycarbonate, polyurethane, epoxy, acetal, butyral, formal, phenoxy, or cellulose resins, and polyvinylpyrrolidone may also be used. In order to modify the properties of polyvinylpyrrolidone, another modification product, that is, a material prepared by crosslinking a part of polyvinylpyrrolidone may also be used. The modification product suitable for use in the present invention has a molecular weight in the range of 100 to 3000 ($\times 10^3$) as measured by GPC.

The addition amount of the polyvinylpyrrolidone resin is 98% by weight, to 60% by weight, preferably 98% by weight to 85% by weight, based on the total solid content of the component for forming the adhesive layer.

When the modification product of the polyvinylpyrrolidone resin is incorporated, the addition amount of the modification product is 20 to 80% by weight, preferably 30 to 70% by weight, based on the polyvinylpyrrolidone resin. When the addition amount falls within the above-defined range, the water absorption of the polyvinylpyrrolidone resin can be suppressed, and the adhesion at room temperature can be improved.

Group (A)

The polyurethane resin and the acrylic polyol resin may be conventional materials such as solid form or organic solution dilution type. In this case, however, the polyurethane resin and acrylic polyol resin are soluble in a mixed solvent composed of methyl ethyl ketone (MEK) and isopropyl alcohol (IPA) at a weight ratio 1:1 (MEK/IPA=1/1) and, even when diluted to a solid content of 5% by weight, do not gel. The addition of the above polyurethane resin or acrylic polyol resin can realize excellent suitability for coating.

In the present invention, preferably, the polyurethane resin and the acrylic polyol resin can be crosslinked or cured with an isocyanate, a blocked isocyanate, or an aluminum chelating agent in the group (B). The effect of the present invention can be attained by using the above compounds as a mixed solution with the polyvinylpyrrolidone resin or a mixture of the polyvinylpyrrolidone resin and the modification product of the polyvinylpyrrolidone resin. The polyurethane resin usable in the present invention may be a commercially available product, and examples thereof include SANPRENE IB-114B (manufactured by Sanyo Chemical Industries, Ltd.). Examples of commercially available products of the acrylic polyol resin include Acrydic A-801-P (manufactured by Dainippon Ink and Chemicals, Inc.). The acrylic polyol resin is a polymer comprising hydroxyl group-containing (meth) acrylic monomer units, for example, poly(hydroxyethyl methacrylate) and has, as a solid, an acid value of about 1 to 15 and a hydroxyl value of about 20 to 150.

The addition amount of at least one component selected from the group consisting of polyurethane resins and acrylic polyol resins is 1 to 30% by weight, preferably 1 to 100% by weight, based on the total solid content of the component for forming the adhesive layer. When the addition amount falls within the above-defined range, the function as the adhesive component is satisfactory. Further, as compared with an adhesive layer formed of a polyvinylpyrrolidone resin alone, the print density can be improved.

Group (B)

The isocyanate, blocked isocyanate, and aluminum chelating agent may be conventional materials such as solid form or organic solution dilution type. In this case, however, the isocyanate, blocked isocyanate, and aluminum chelating agent are soluble in a mixed solvent composed of methyl ethyl ketone (MEK) and isopropyl alcohol (IPA) at a weight ratio 1:1 (MEK/IPA=1/1) and, even when diluted to a solid content of 5% by weight, do not gel. The addition of the isocyanate, blocked isocyanate, and aluminum chelating agent can realize excellent suitability for coating.

Specific examples of isocyanates include hexamethylene diisocyanate (HDI), xylene diisocyate (XDI), methylene diisocyanate (MDI), isophorone diisocyanate (IPDI), hydrogenated xylene diisocyanate ($H_6XDI$), and dimmers or trimers of these isocyanate monomers, for example, isocyanurate compounds, adduct compounds, and biuret compounds. Specific examples of blocked isocyanates include those in which an isocyanate group has been masked, for example, with oxime or lactam. Specific examples of aluminum chelating agents include aluminum salts of ethylenediaminetetraacetic acid (EDTA), hydroxyethylethylenediaminetriacetic acid (HEDTA), dihydroxyethylethylenediaminediacetic acid (DHEDDA) and the like. The compounds belonging to the group (B) may be commercially available products, and examples thereof include Takenate A-14 (manufactured by MITSUI TAKEDA CHEMICALS, INC.) (isocyanate), NK ASSIST IS-80D (manufactured by Nicca Chemical Co., Ltd.) (blocked isocyanate), and DICNATE AL500 (manufactured by Dainippon Ink and Chemicals, Inc.) (aluminum chelating agent).

The addition amount of at least one component selected from the group consisting of isocyanates, blocked isocyanates, and aluminum chelating agents is 1 to 10% by weight, preferably 1 to 5% by weight, based on the total solid content of the component for forming the adhesive layer. When the addition amount falls within the above-defined range, the function of curing the polyurethane resin and the acrylic polyol resin is satisfactory and the stability of the coating liquid is good.

Optional Components

In order to improve the function as the adhesive layer, optional components in addition to the above components, may be added to the adhesive layer. Specific examples of optional components include polyester resins, vinyl resins such as polyacrylic ester resins, polyvinyl acetate resins, styrene acrylate resins, polyacrylamide resins, polyamide resins, polyether resins, polystyrene resins, polyethylene resins, polypropylene resins, polyvinyl chloride resins and vinylchloride-vinyl acetate copolymer resins, and ethylene-vinyl acetate copolymer resins, and polyvinylacetal resins such as polyvinylacetoacetal and polyvinylbutyral. Among them, polyester resins and acrylic resins are preferred from the viewpoint of improving the adhesion.

The addition amount of the optional component is preferably 1 to 10% by weight based on the total solid content of the component for forming the adhesive layer. When the addition amount falls within the above-defined range, the polyvinylpyrrolidone resin-derived print density can be improved. Further, the application of the adhesive layer to substrates not subjected to corona discharge treatment or other treatment is also possible.

Such other optional components include, for example, wettability improvers, fluorescent brighteners, and various fillers.

Formation of Adhesive Layer

The adhesive layer may be formed by mixing the polyvinylpyrrolidone resin (optionally in combination with a modification product of polyvinylpyrrolidone resin) with the component in the group (A), the component in the group (B), and optional components, dissolving or dispersing the mixture in an organic solvent or an aqueous solvent to prepare a coating liquid, and coating the coating liquid by conventional coating means such as gravure printing, screen printing, or reverse roll coating using a gravure plate. Regarding the solvent, a mixed solvent composed of MEK and IPA is suitable because the mixed solvent can well dissolve the above materials and can easily control the viscosity in the coating. In the preparation of the coating liquid, when the total solid content is brought to 3 to 7% by weight, good suitability for coating can be realized. When the total solid content falls within the above-described range, the suitability for coating is improved and the viscosity can be maintained at a proper value. As a result, the suitability for coating in gravure printing can be significantly improved. Therefore, also for the polyurethane resin and the acrylic polyol resin, materials, which, when diluted to a solid content of about 5% by weight with a mixed solvent composed of MEK and IPA, do not gel, are preferably selected. Further, also for the isocyanate, blocked isocyanate, and aluminum chelating agent, materials, which, when diluted to a solid content of about 5% by weight with a mixed solvent composed of MEK and IPA, do not gel, should be selected.

The adhesive layer may be coated as a blotted image onto the whole area on the dye layer coating side of the substrate, or alternatively may be formed in a pattern form only between the substrate and the dye layer. The coverage of the adhesive layer on a dry basis is 0.01 to 3.0 g/m$^2$, preferably 0.05 to 0.3 g/m$^2$. When the coverage of the adhesive layer falls within the above-defined range, the concaves and convexes on the substrate can be eliminated by filling with the adhesive layer and any uncoated part does not occur. Therefore, in the thermal transfer, abnormal transfer in which the dye layer is transferred to an image receiving sheet on its receptive layer side can be effectively prevented. Further, mixing of the adhesive layer with the dye layer in the coating of the dye layer can be prevented, and abnormal transfer, in which the receptive layer is transferred to the dye layer side at the time of thermal transfer, can be effectively prevented.

EXAMPLES

The following Examples further illustrate the contents of the first to fifth aspects of the present invention. However, the invention is not to be construed as being limited thereto. In the Examples (Comparative Examples), parts or % is by weight unless otherwise specified.

First Aspect of the Present Invention

Example A1

A 4.5 μm-thick untreated polyethylene terephthalate (PET) film (DIAFOIL K 880, manufactured by Mitsubishi Polyester Film Co., Ltd.) was provided as a substrate. A liquid composition A1 having the following composition for an adhesive layer was gravure coated onto the PET film at a coverage of 0.03 g/m$^2$ on a dry basis, and the coating was dried at 110° C. for one min to form an adhesive layer. A liquid composition A having the following composition for a dye layer was then gravure coated on the adhesive layer at a coverage of 0.8 g/m$^2$ on a dry basis, and the coating was dried to form a dye layer. Thus, a thermal transfer sheet of Example A1 was prepared. In this case, a liquid composition A having the following composition for a heat resistant slip layer was previously gravure coated on the other side of the substrate at a coverage of 1.0 g/m$^2$ on a dry basis, and the coating was dried to form a heat resistant slip layer.

| | |
|---|---|
| <Liquid composition A1 for adhesive layer> | |
| Polyvinylpyrrolidone resin (K-90, manufactured by ISP Ltd.) | 9 parts |
| Vinyl acetate modified polyvinylpyrrolidone resin (I-335, manufactured by ISP Ltd., solid content 50%) | 2 parts |
| Methyl ethyl ketone | 83 parts |
| Isopropyl alcohol | 82 parts |
| <Liquid composition A for dye layer> | |
| C.I. Solvent Blue 22 | 5.5 parts |
| Polyvinyl acetal resin (S-lec KS-5, manufactured by Sekisui Chemical Co., Ltd.) | 3.0 parts |
| Methyl ethyl ketone | 22.5 parts |
| Toluene | 68.2 parts |
| <Liquid composition A for heat resistant slip layer> | |
| Polyvinyl butyral resin (S-lec BX-1, manufactured by Sekisui Chemical Co., Ltd.) | 13.6 parts |
| Polyisocyanate curing agent (Takenate D 218, manufactured by Takeda Chemical Industries, Ltd.) | 0.6 part |

-continued

| | |
|---|---|
| Phosphoric ester (Plysurf A 208 S, manufactured by Dai-Ichi Kogyo Seiyaku Co., Ltd.) | 0.8 part |
| Methyl ethyl ketone | 42.5 parts |
| Toluene | 42.5 parts |

Example A2

The same substrate of PET film as used in Example A1 was provided. A heat resistant slip layer as described in Example A1 was previously formed on the other side of the substrate. The liquid composition for an adhesive layer as used in Example A1 was gravure coated onto the substrate on its side remote from the heat resistant slip layer at a coverage of 0.05 g/m$^2$ on a dry basis, and the coating was dried to form an adhesive layer. A dye layer was formed on the adhesive layer in the same manner as in Example A1. Thus, a thermal transfer sheet of Example A2 was prepared.

Example A3

The same substrate of PET film as used in Example A1 was provided. A heat resistant slip layer as described in Example A1 was previously formed on the other side of the substrate. The coating liquid for an adhesive layer used in Example A1 was gravure coated onto the substrate on its side remote from the heat resistant slip layer at a coverage of 0.1 g/m$^2$ on a dry basis, and the coating was dried to form an adhesive layer. A dye layer was formed on the adhesive layer in the same manner as in Example A1. Thus, a thermal transfer sheet of Example A3 was prepared.

Example A4

The same substrate of PET film as used in Example A1 was provided. A heat resistant slip layer as described in Example A1 was previously formed on the other side of the substrate. The coating liquid for an adhesive layer used in Example A1 was gravure coated onto the substrate on its side remote from the heat resistant slip layer at a coverage of 0.2 g/m$^2$ on a dry basis, and the coating was dried to form an adhesive layer. A dye layer was formed on the adhesive layer in the same manner as in Example A1. Thus, a thermal transfer sheet of Example A4 was prepared.

Example A5

The same substrate of PET film as used in Example A1 was provided. A heat resistant slip layer as described in Example A1 was previously formed on the other side of the substrate. The coating liquid for an adhesive layer used in Example A1 was gravure coated onto the substrate on its side remote from the heat resistant slip layer at a coverage of 0.25 g/m$^2$ on a dry basis, and the coating was dried to form an adhesive layer. A dye layer was formed on the adhesive layer in the same manner as in Example A1. Thus, a thermal transfer sheet of Example A5 was prepared.

Example A6

The same substrate of PET film as used in Example A1 was provided. A heat resistant slip layer as described in Example A1 was previously formed on the other side of the substrate. The coating liquid for an adhesive layer used in Example A1 was gravure coated onto the substrate on its side remote from the heat resistant slip layer at a coverage of 0.35 g/m$^2$ on a dry basis, and the coating was dried to form an adhesive layer. A dye layer was formed on the adhesive layer in the same manner as in Example A1. Thus, a thermal transfer sheet of Example A6 was prepared.

Example A7

The same substrate of PET film as used in Example A1 was provided. A heat resistant slip layer as described in Example A1 was previously formed on the other side of the substrate. A coating liquid A2 for an adhesive layer having the following composition was gravure coated onto the substrate on its side remote from the heat resistant slip layer at a coverage of 0.06 g/m$^2$ on a dry basis, and the coating was dried to form an adhesive layer. A dye layer was formed on the adhesive layer in the same manner as in Example A1. Thus, a thermal transfer sheet of Example A7 was prepared.

| <Liquid composition A2 for adhesive layer> | |
|---|---|
| Polyvinylpyrrolidone resin (K-90, manufactured by ISP Ltd.) | 5 parts |
| Vinyl acetate modified polyvinylpyrrolidone resin (I-335, manufactured by ISP Ltd., solid content 50%) | 10 parts |
| Methyl ethyl ketone | 83 parts |
| Isopropyl alcohol | 78 parts |

Example A8

The same substrate of PET film as used in Example A1 was provided. A heat resistant slip layer as described in Example A1 was previously formed on the other side of the substrate. A coating liquid A3 for an adhesive layer having the following composition was gravure coated onto the substrate on its side remote from the heat resistant slip layer at a coverage of 0.03 g/m$^2$ on a dry basis, and the coating was dried to form an adhesive layer. A dye layer was formed on the adhesive layer in the same manner as in Example A1. Thus, a thermal transfer sheet of Example A8 was prepared.

| <Liquid composition A3 for adhesive layer> | |
|---|---|
| Polyvinylpyrrolidone resin (K-90, manufactured by ISP Ltd.) | 9 parts |
| Vinyl acetate modified polyvinylpyrrolidone resin (S-630, manufactured by ISP Ltd.) | 1 part |
| Methyl ethyl ketone | 83 parts |
| Isopropyl alcohol | 83 parts |

Example A9

The same substrate of PET film as used in Example A1 was provided. A heat resistant slip layer as described in Example A1 was previously formed on the other side of the substrate. The coating liquid for an adhesive layer used in Example A8 was gravure coated onto the substrate on its side remote from the heat resistant slip layer at a coverage of 0.05 g/m$^2$ on a dry basis, and the coating was dried to form an adhesive layer. A dye layer was formed on the adhesive layer in the same manner as in Example A1. Thus, a thermal transfer sheet of Example A9 was prepared.

Example A10

The same substrate of PET film as used in Example A1 was provided. A heat resistant slip layer as described in Example A1 was previously formed on the other side of the substrate. The coating liquid for an adhesive layer used in Example A8 was gravure coated onto the substrate on its side remote from the heat resistant slip layer at a coverage of 0.2 g/m$^2$ on a dry basis, and the coating was dried to form an adhesive layer. A dye layer was formed on the adhesive layer in the same manner as in Example A1. Thus, a thermal transfer sheet of Example A10 was prepared.

Example A11

The same substrate of PET film as used in Example A1 was provided. A heat resistant slip layer as described in Example A1 was previously formed on the other side of the substrate. The coating liquid for an adhesive layer used in Example A8 was gravure coated onto the substrate on its side remote from the heat resistant slip layer at a coverage of 0.35 g/m$^2$ on a dry basis, and the coating was dried to form an adhesive layer. A dye layer was formed on the adhesive layer in the same manner as in Example A1. Thus, a thermal transfer sheet of Example A11 was prepared.

Example A12

The same substrate of PET film as used in Example A1 was provided. A heat resistant slip layer as described in Example A1 was previously formed on the other side of the substrate. A coating liquid A4 for an adhesive layer having the following composition was gravure coated onto the substrate on its side remote from the heat resistant slip layer at a coverage of 0.2 g/m$^2$ on a dry basis, and the coating was dried to form an adhesive layer. A dye layer was formed on the adhesive layer in the same manner as in Example A1. Thus, a thermal transfer sheet of Example A12 was prepared.

| <Liquid composition A4 for adhesive layer> | |
|---|---|
| Polyvinylpyrrolidone resin (K-90, manufactured by ISP Ltd.) | 7 parts |
| Vinyl acetate modified polyvinylpyrrolidone resin (S-630, manufactured by ISP Ltd.) | 3 parts |
| Methyl ethyl ketone | 83 parts |
| Isopropyl alcohol | 83 parts |

Example A13

The same substrate of PET film as used in Example A1 was provided. A heat resistant slip layer as described in Example A1 was previously formed on the other side of the substrate. A coating liquid A5 for an adhesive layer having the following composition was gravure coated onto the substrate on its side remote from the heat resistant slip layer at a coverage of 0.06 g/m$^2$ on a dry basis, and the coating was dried to form an adhesive layer. A dye layer was formed on the adhesive layer in the same manner as in Example A1. Thus, a thermal transfer sheet of Example A13 was prepared.

| <Liquid composition A5 for adhesive layer> | |
|---|---|
| Polyvinylpyrrolidone resin (K-90, manufactured by ISP Ltd.) | 5 parts |
| Vinyl acetate modified polyvinylpyrrolidone resin (S-630, manufactured by ISP Ltd.) | 5 parts |
| Methyl ethyl ketone | 83 parts |
| Isopropyl alcohol | 83 parts |

Example A14

The same substrate of PET film as used in Example A1 was provided. A heat resistant slip layer as described in Example A1 was previously formed on the other side of the substrate. A coating liquid A6 for an adhesive layer having the following composition was gravure coated onto the substrate on its side remote from the heat resistant slip layer at a coverage of 0.03 g/m$^2$ on a dry basis, and the coating was dried to form an adhesive layer. A dye layer was formed on the adhesive layer in the same manner as in Example A1. Thus, a thermal transfer sheet of Example A14 was prepared.

| <Liquid composition A6 for adhesive layer> | |
|---|---|
| Polyvinylpyrrolidone resin (K-90, manufactured by ISP Ltd.) | 9 parts |
| Styrene modified polyvinylpyrrolidone resin (ANTARA430, manufactured by ISP Ltd., solid content 40%) | 2.5 parts |
| Water | 81.5 parts |
| Isopropyl alcohol | 83 parts |

Example A15

The same substrate of PET film as used in Example A1 was provided. A heat resistant slip layer as described in Example A1 was previously formed on the other side of the substrate. The coating liquid for an adhesive layer used in Example A14 was gravure coated onto the substrate on its side remote from the heat resistant slip layer at a coverage of 0.05 g/m$^2$ on a dry basis, and the coating was dried to form an adhesive layer. A dye layer was formed on the adhesive layer in the same manner as in Example A1. Thus, a thermal transfer sheet of Example A15 was prepared.

Example A16

The same substrate of PET film as used in Example A1 was provided. A heat resistant slip layer as described in Example A1 was previously formed on the other side of the substrate. The coating liquid for an adhesive layer used in Example A14 was gravure coated onto the substrate on its side remote from the heat resistant slip layer at a coverage of 0.2 g/m$^2$ on a dry basis, and the coating was dried to form an adhesive layer. A dye layer was formed on the adhesive layer in the same manner as in Example A1. Thus, a thermal transfer sheet of Example A16 was prepared.

Example A17

The same substrate of PET film as used in Example A1 was provided. A heat resistant slip layer as described in Example A1 was previously formed on the other side of the substrate. The coating liquid for an adhesive layer used in Example A14 was gravure coated onto the substrate on its side remote from the heat resistant slip layer at a coverage of 0.35 g/m$^2$ on a dry basis, and the coating was dried to form an adhesive layer. A dye layer was formed on the adhesive layer in the same manner as in Example A1. Thus, a thermal transfer sheet of Example A17 was prepared.

Example A18

The same substrate of PET film as used in Example A1 was provided. A heat resistant slip layer as described in Example A1 was previously formed on the other side of the substrate. A coating liquid A7 for an adhesive layer having the following composition was gravure coated onto the substrate on its side remote from the heat resistant slip layer at a coverage of 0.06 g/m$^2$ on a dry basis, and the coating was dried to form an adhesive layer. A dye layer was formed on the adhesive layer in the same manner as in Example A1. Thus, a thermal transfer sheet of Example A18 was prepared.

| <Liquid composition A7 for adhesive layer> | |
|---|---|
| Polyvinylpyrrolidone resin (K-90, manufactured by ISP Ltd.) | 5 parts |
| Styrene modified polyvinylpyrrolidone resin (ANTARA430, manufactured by ISP Ltd., solid content 40%) | 12.5 parts |
| Water | 75.5 parts |
| Isopropyl alcohol | 83 parts |

Example A19

The same substrate of PET film as used in Example A1 was provided. A heat resistant slip layer as described in Example A1 was previously formed on the other side of the substrate. A coating liquid A8 for an adhesive layer having the following composition was gravure coated onto the substrate on its side remote from the heat resistant slip layer at a coverage of 0.06 g/m$^2$ on a dry basis, and the coating was dried to form an adhesive layer. A dye layer was formed on the adhesive layer in the same manner as in Example A1. Thus, a thermal transfer sheet of Example A19 was prepared.

| <Liquid composition A8 for adhesive layer> | |
|---|---|
| Polyvinylpyrrolidone resin (K-90, manufactured by ISP Ltd.) | 9.5 parts |
| Vinyl acetate modified polyvinylpyrrolidone resin (I-335, manufactured by ISP Ltd., solid content 50%) | 1 part |
| Methyl ethyl ketone | 83 parts |
| Isopropyl alcohol | 82.5 parts |

Example A20

The same substrate of PET film as used in Example A1 was provided. A heat resistant slip layer as described in Example A1 was previously formed on the other side of the substrate. A coating liquid A9 for an adhesive layer having the following composition was gravure coated onto the substrate on its side remote from the heat resistant slip layer at a coverage of 0.06 g/m$^2$ on a dry basis, and the coating was dried to form an adhesive layer. A dye layer was formed on the adhesive layer in the same manner as in Example A1. Thus, a thermal transfer sheet of Example A20 was prepared.

| <Liquid composition A9 for adhesive layer> | |
|---|---|
| Polyvinylpyrrolidone resin (K-90, manufactured by ISP Ltd.) | 2.5 parts |
| Vinyl acetate modified polyvinylpyrrolidone resin (I-335, manufactured by ISP Ltd., solid content 50%) | 15 parts |
| Methyl ethyl ketone | 83 parts |
| Isopropyl alcohol | 75.5 parts |

Example A21

The same substrate of PET film as used in Example A1 was provided. A heat resistant slip layer as described in Example A1 was previously formed on the other side of the substrate. A coating liquid A10 for an adhesive layer having the following composition was gravure coated onto the substrate on its side remote from the heat resistant slip layer at a coverage of 0.06 g/m$^2$ on a dry basis, and the coating was dried to form an adhesive layer. A dye layer was formed on the adhesive layer in the same manner as in Example A1. Thus, a thermal transfer sheet of Example A21 was prepared.

| <Liquid composition A10 for adhesive layer> | |
|---|---|
| Polyvinylpyrrolidone resin (K-90, manufactured by ISP Ltd.) | 9.5 parts |
| Vinyl acetate modified polyvinylpyrrolidone resin (S-630, manufactured by ISP Ltd.) | 0.5 part |
| Methyl ethyl ketone | 83 parts |
| Isopropyl alcohol | 83 parts |

Example A22

The same substrate of PET film as used in Example A1 was provided. A heat resistant slip layer as described in Example A1 was previously formed on the other side of the substrate. A coating liquid A11 for an adhesive layer having the following composition was gravure coated onto the substrate on its side remote from the heat resistant slip layer at a coverage of 0.06 g/m$^2$ on a dry basis, and the coating was dried to form an adhesive layer. A dye layer was formed on the adhesive layer in the same manner as in Example A1. Thus, a thermal transfer sheet of Example A22 was prepared.

| <Liquid composition A11 for adhesive layer> | |
|---|---|
| Polyvinylpyrrolidone resin (K-90, manufactured by ISP Ltd.) | 2.5 parts |
| Vinyl acetate modified polyvinylpyrrolidone resin (S-630, manufactured by ISP Ltd.) | 7.5 parts |
| Methyl ethyl ketone | 83 parts |
| Isopropyl alcohol | 83 parts |

Example A23

The same substrate of PET film as used in Example A1 was provided. A heat resistant slip layer as described in Example A1 was previously formed on the other side of the substrate. A coating liquid A12 for an adhesive layer having the following composition was gravure coated onto the substrate on its side remote from the heat resistant slip layer at a coverage of 0.06 g/m$^2$ on a dry basis, and the coating was dried to form an adhesive layer. A dye layer was formed on the adhesive layer in the same manner as in Example A1. Thus, a thermal transfer sheet of Example A23 was prepared.

| <Liquid composition A12 for adhesive layer> | |
|---|---|
| Polyvinylpyrrolidone resin (K-90, manufactured by ISP Ltd.) | 9.5 parts |
| Styrene modified polyvinylpyrrolidone resin (ANTARA430, manufactured by ISP Ltd., solid content 40%) | 1.25 parts |
| Water | 82.25 parts |
| Isopropyl alcohol | 83 parts |

Example A24

The same substrate of PET film as used in Example A1 was provided. A heat resistant slip layer as described in Example A1 was previously formed on the other side of the substrate. A coating liquid A13 for an adhesive layer having the following composition was gravure coated onto the substrate on its side remote from the heat resistant slip layer at a coverage of 0.06 g/m$^2$ on a dry basis, and the coating was dried to form an adhesive layer. A dye layer was formed on the adhesive layer in the same manner as in Example A1. Thus, a thermal transfer sheet of Example A24 was prepared.

| <Liquid composition A13 for adhesive layer> | |
|---|---|
| Polyvinylpyrrolidone resin (K-90, manufactured by ISP Ltd.) | 2.5 parts |
| Styrene modified polyvinylpyrrolidone resin (ANTARA430, manufactured by ISP Ltd., solid content 40%) | 18.75 parts |
| Water | 71.75 parts |
| Isopropyl alcohol | 83 parts |

Comparative Example A1

The same substrate of PET film as used in Example A1 was provided. A heat resistant slip layer as described in Example A1 was previously formed on the other side of the substrate. A coating liquid A14 for an adhesive layer having the following composition was gravure coated onto the substrate on its side remote from the heat resistant slip layer at a coverage of 0.06 g/m$^2$ on a dry basis, and the coating was dried to form an adhesive layer. A dye layer was formed on the adhesive layer in the same manner as in Example A1. Thus, a thermal transfer sheet of Comparative Example A1 was prepared.

| <Liquid composition A14 for adhesive layer> | |
|---|---|
| Polyvinylpyrrolidone resin (K-90, manufactured by ISP Ltd.) | 10 parts |
| Methyl ethyl ketone | 83 parts |
| Isopropyl alcohol | 83 parts |

Comparative Example A2

The same substrate of PET film as used in Example A1 was provided. A heat resistant slip layer as described in Example A1 was previously formed on the other side of the substrate. A dye layer was formed onto the substrate on its side remote from the heat resistant slip layer in the same manner as in Example A1, except that the dye layer was formed directly onto the substrate without providing the adhesive layer. Thus, a thermal transfer sheet of Comparative Example A2 was prepared.

Evaluation Test A

The thermal transfer sheets of Example A and Comparative Example A were evaluated for heat-resistant adhesion at room temperature and under high-temperature and high-humidity conditions and adhesion to an image-receiving sheet by the following methods.

(Evaluation 1: Heat Resistant Adhesion 1)

Each of the thermal transfer sheets of Example A and Comparative Example A as a sample was applied onto a mount so that the dye layer surface faced upward, that is, the mount was brought into contact with the heat resistant slip layer. A reference ribbon 1 (an assembly comprising a dye layer, which is the same as that in the sample, provided directly on an easy-adhesion treated PET film of DIAFOIL K230E manufactured by MITSUBISHI POLYESTER FILM CORPORATION as a substrate) corresponding to the sample was applied onto the identical mount at its position different from the position of the sample so that the surface of the dye layer faced upward. Each mount was folded back so that dye layer surface in the sample and the dye layer surface in the reference ribbon were put on top of and brought into contact with each other. In this state, heat sealing was carried out under conditions of temperature 100 to 130° C., pressure $34.3\times10^4$ Pa, and pressing time 2 sec, followed by separation. The assembly was then visually inspected for residual dye layer (undesired transfer of dye layer) in each of the sample and the reference ribbon 1. The results were evaluated according to the following criteria. In this case, the heat resistant adhesion test was carried out by the following two testing methods. In one of the testing methods, the heat sealing was carried out in such a state that both the thermal transfer sheets of Example A and Comparative Example A as samples and the reference ribbon 1 were allowed to stand at room temperature. In the other testing method, the heat sealing was carried out after both the sample thermal transfer sheets and the reference ribbon 1 were allowed to stand under an environment of 40° C. and 90% RH for 16 hr.

Evaluation Criteria

○: The area of the dye layer remaining on the sample side is larger than the area of the dye layer remaining on the reference ribbon side.

Δ: The area of the dye layer remaining on the sample side is equal to the area of the dye layer remaining on the reference ribbon side.

x: The area of the dye layer remaining on the sample side is smaller than the area of the dye layer remaining on the reference ribbon side.

(Evaluation 2: Heat Resistant Adhesion 2)

Each of the thermal transfer sheets of Example A and Comparative Example A as a sample was applied onto a mount so that the dye layer surface faced upward, that is, the mount was brought into contact with the heat resistant slip layer. A reference ribbon 2 (an assembly comprising a dye layer, which is the same as that in the sample, provided on a substrate comprising an adhesive layer formed of a polyvinylpyrrolidone resin (K-90, manufactured by ISP Ltd.) (the same as the adhesive layer in Comparative Example A1) provided at a coverage of 0.06 g/m$^2$ on a dry basis on a surface of a PET film of DIAFOIL K880 manufactured by MITSUBISHI POLYESTER FILM CORPORATION) corresponding to the sample was applied onto the identical mount at its position different from the position of the sample so that the surface of the dye layer faced upward. Each mount was folded back so that dye layer surface in the sample and the dye layer surface in the reference ribbon were put on top of and brought into contact with each other. In this state, heat sealing was carried out under conditions of temperature 100 to 130° C., pressure $34.3\times10^4$ Pa, and pressing time 2 sec, followed by separation. The assembly was then visually inspected for residual dye layer (undesired transfer of dye layer) in each of the sample and the reference ribbon 2. The results were evaluated according to the same criteria as the heat resistant adhesion 1. In this case, the heat resistant adhesion test was carried out by the following two testing methods. In one of the testing methods, the heat sealing was carried out in such a state that both the thermal transfer sheets of Example A and Comparative Example A as samples and the reference ribbon 2 were allowed to stand at room temperature. In the other testing method, the heat sealing was carried out after both the sample thermal transfer sheets and the reference ribbon 2 were allowed to stand under an environment of 40° C. and 90% RH for 16 hr.

(Adhesion to Image Receiving Sheet)

Each of the thermal transfer sheets of Example A and Comparative Example A and a specialty standard set of an image receiving sheet for a digital color printer P-200, manufactured by Olympus Optical Co., LTD. were put on top of each other so that the dye layer surface in the thermal transfer sheet was brought into contact with the image receiving surface in the image receiving sheet. The assembly was heat sealed under conditions of temperature 100 to 130° C., pressure $34.3\times10^4$ Pa, and pressing time 2 sec. Thereafter, both the sheets were separated from each other and were visually inspected for the state of separation between the dye layer in the sample and the image receiving layer in the image receiving sheet, and the results were evaluated according to the following criteria. In this case, the heat sealing of the thermal transfer sheet and the image receiving sheet was carried out in such a state that these sheets were allowed to stand at room temperature.

Evaluation Criteria

○: No abnormal transfer of image receiving layer onto dye layer side took place.

x: Abnormal transfer of image receiving layer onto dye layer side took place.

The results of the evaluation of each item will be shown in Table 1 below.

TABLE 1

| | Addition amount of modified pol-yvinyl pyrrolidone resin *1 | Coverage, g/m | Heat resistant adhesion 1 | | Heat resistant adhesion 2 | | Adhesion to image receiving sheet |
|---|---|---|---|---|---|---|---|
| | | | Room temp. | High temp. and high humidity conditions | Room temp. | High temp. and high humidity conditions | |
| Example A1 | 10% | 0.03 | ○ | ○ | Δ | ○ | ○ |
| Example A2 | 10% | 0.05 | ○ | ○ | ○ | ○ | ○ |
| Example A3 | 10% | 0.1 | ○ | ○ | ○ | ○ | ○ |
| Example A4 | 10% | 0.2 | ○ | ○ | ○ | ○ | ○ |
| Example A5 | 10% | 0.25 | ○ | ○ | ○ | ○ | ○ |
| Example A6 | 10% | 0.35 | ○ | ○ | ○ | ○ | X |
| Example A7 | 50% | 0.06 | ○ | ○ | ○ | ○ | ○ |
| Example A8 | 10% | 0.03 | ○ | ○ | Δ | ○ | ○ |
| Example A9 | 10% | 0.05 | ○ | ○ | ○ | ○ | ○ |
| Example A10 | 10% | 0.2 | ○ | ○ | ○ | ○ | ○ |
| Example A11 | 10% | 0.35 | ○ | ○ | ○ | ○ | X |
| Example A12 | 30% | 0.2 | ○ | ○ | ○ | ○ | ○ |
| Example A13 | 50% | 0.06 | ○ | ○ | ○ | ○ | ○ |
| Example A14 | 10% | 0.03 | ○ | ○ | Δ | ○ | ○ |
| Example A15 | 10% | 0.05 | ○ | ○ | ○ | ○ | ○ |
| Example A16 | 10% | 0.2 | ○ | ○ | ○ | ○ | ○ |
| Example A17 | 10% | 0.35 | ○ | ○ | ○ | ○ | X |
| Example A18 | 50% | 0.06 | ○ | ○ | ○ | ○ | ○ |
| Example A19 | 5% | 0.06 | ○ | X | Δ | ○ | ○ |
| Example A20 | 75% | 0.06 | ○ | ○ | X | ○ | ○ |
| Example A21 | 5% | 0.06 | ○ | X | Δ | ○ | ○ |
| Example A22 | 75% | 0.06 | ○ | ○ | X | ○ | ○ |
| Example A23 | 5% | 0.06 | ○ | X | Δ | ○ | ○ |
| Example A24 | 75% | 0.06 | ○ | ○ | X | ○ | ○ |
| Comparative Example A1 | 0% | 0.06 | ○ | X | — | — | ○ |
| Comparative Example A2 | — | — | X | X | X | X | ○ |

*1: The addition amount of modified PVP is the percentage of addition amount based on the total amount of the modified PVP and the polyvinylpyrrolidone resin (K-90, manufactured by ISP Ltd.). The percentage of addition amount is on a solid content basis.

Second Aspect of the Present Invention

Example B1

A 4.5 μm-thick untreated polyethylene terephthalate (PET) film (DIAFOIL K 880, manufactured by Mitsubishi Polyester Film Co., Ltd.) was provided as a substrate. A liquid composition B1 having the following composition for an adhesive layer was gravure coated onto the PET film at a coverage of 0.06 g/m$^2$ on a dry basis, and the coating was dried at 110° C. for one min to form an adhesive layer. A liquid composition B having the following composition for a dye layer was then gravure coated on the adhesive layer at a coverage of 0.8 g/m$^2$ on a dry basis, and the coating was dried to form a dye layer. Thus, a thermal transfer sheet of Example B1 was prepared. In this case, a liquid composition B having the following composition for a heat resistant slip layer was previously gravure coated on the other side of the substrate at a coverage of 1.0 g/m$^2$ on a dry basis, and the coating was dried to form a heat resistant slip layer.

| <Liquid composition B1 for adhesive layer> | |
|---|---|
| Polyvinylpyrrolidone resin (K-90, manufactured by ISP Ltd.) | 9.5 parts |
| D-mannitol (Marine Crystal, manufactured by Towa Chemical Industry Co., Ltd.) | 0.5 part |
| Water | 83 parts |
| Isopropyl alcohol | 83 parts |
| <Liquid composition B for dye layer> | |
| C.I. Solvent Blue 22 | 5.5 parts |
| Polyvinyl acetal resin (S-lec KS-5, manufactured by Sekisui Chemical Co., Ltd.) | 3.0 parts |
| Methyl ethyl ketone | 22.5 parts |
| Toluene | 68.2 parts |
| <Liquid composition B for heat resistant slip layer> | |
| Polyvinyl butyral resin (S-lec BX-1, manufactured by Sekisui Chemical Co., Ltd.) | 13.6 parts |
| Polyisocyanate curing agent (Takenate D 218, manufactured by Takeda Chemical Industries, Ltd.) | 0.6 part |
| Phosphoric ester (Plysurf A 208 S, manufactured by Dai-Ichi Kogyo Seiyaku Co., Ltd.) | 0.8 part |
| Methyl ethyl ketone | 42.5 parts |
| Toluene | 42.5 parts |

Example B2

The same substrate of PET film as used in Example B1 was provided. A heat resistant slip layer as described in Example B1 was previously formed on the other side of the substrate. A liquid composition B2 for an adhesive layer having the following composition was gravure coated onto the substrate on its side remote from the heat resistant slip layer at a coverage of 0.06 g/m$^2$ on a dry basis, and the coating was dried to form an adhesive layer. A dye layer was formed on the adhesive layer in the same manner as in Example B1. Thus, a thermal transfer sheet of Example B2 was prepared.

| <Liquid composition B2 for adhesive layer> | |
|---|---|
| Polyvinylpyrrolidone resin (K-90, manufactured by ISP Ltd.) | 9.0 parts |
| D-mannitol (Marine Crystal, manufactured by Towa Chemical Industry Co., Ltd.) | 1.0 part |
| Water | 83 parts |
| Isopropyl alcohol | 83 parts |

Example B3

The same substrate of PET film as used in Example B1 was provided. A heat resistant slip layer as described in Example B1 was previously formed on the other side of the substrate. A coating liquid B3 for an adhesive layer having the following composition was gravure coated onto the substrate on its side remote from the heat resistant slip layer at a coverage of 0.06 g/m$^2$ on a dry basis, and the coating was dried to form an adhesive layer. A dye layer was formed on the adhesive layer in the same manner as in Example B1. Thus, a thermal transfer sheet of Example B3 was prepared.

| <Liquid composition B3 for adhesive layer> | |
|---|---|
| Polyvinylpyrrolidone resin (K-90, manufactured by ISP Ltd.) | 9.5 parts |
| Reducing maltose (Amalty MR50, manufactured by Towa Chemical Industry Co., Ltd.) | 0.5 part |
| Water | 83 parts |
| Isopropyl alcohol | 83 parts |

Example B4

The same substrate of PET film as used in Example B1 was provided. A heat resistant slip layer as described in Example B1 was previously formed on the other side of the substrate. A liquid composition B4 for an adhesive layer having the following composition was gravure coated onto the substrate on its side remote from the heat resistant slip layer at a coverage of 0.06 g/m$^2$ on a dry basis, and the coating was dried to form an adhesive layer. A dye layer was formed on the adhesive layer in the same manner as in Example B1. Thus, a thermal transfer sheet of Example B4 was prepared.

| <Liquid composition B4 for adhesive layer> | |
|---|---|
| Polyvinylpyrrolidone resin (K-90, manufactured by ISP Ltd.) | 9.0 parts |
| Reducing maltose (Amalty MR50, manufactured by Towa Chemical Industry Co., Ltd.) | 1.0 part |
| Water | 83 parts |
| Isopropyl alcohol | 83 parts |

Example B5

The same substrate of PET film as used in Example B1 was provided. A heat resistant slip layer as described in Example B1 was previously formed on the other side of the substrate. A liquid composition B5 for an adhesive layer having the following composition was gravure coated onto the substrate on its side remote from the heat resistant slip layer at a coverage of 0.06 g/m$^2$ on a dry basis, and the coating was dried to form an adhesive layer. A dye layer was formed on the adhesive layer in the same manner as in Example B1. Thus, a thermal transfer sheet of Example B5 was prepared.

| <Liquid composition B5 for adhesive layer> | |
|---|---|
| Polyvinylpyrrolidone resin (K-90, manufactured by ISP Ltd.) | 9.5 parts |
| D-sorbitol (LTS-P50M, manufactured by Towa Chemical Industry Co., Ltd.) | 0.5 part |
| Water | 83 parts |
| Isopropyl alcohol | 83 parts |

Example B6

The same substrate of PET film as used in Example B1 was provided. A heat resistant slip layer as described in Example B1 was previously formed on the other side of the substrate. A liquid composition B6 for an adhesive layer having the following composition was gravure coated onto the substrate on its side remote from the heat resistant slip layer at a coverage of 0.06 g/m$^2$ on a dry basis, and the coating was dried to form an adhesive layer. A dye layer was formed on the adhesive layer in the same manner as in Example B1. Thus, a thermal transfer sheet of Example B6 was prepared.

| <Liquid composition B6 for adhesive layer> | |
|---|---|
| Polyvinylpyrrolidone resin (K-90, manufactured by ISP Ltd.) | 9.0 parts |
| D-sorbitol (LTS-P50M, manufactured by Towa Chemical Industry Co., Ltd.) | 1.0 part |
| Water | 83 parts |
| Isopropyl alcohol | 83 parts |

Example B7

The same substrate of PET film as used in Example B1 was provided. A heat resistant slip layer as described in Example B1 was previously formed on the other side of the substrate. A liquid composition B7 for an adhesive layer having the following composition was gravure coated onto the substrate on its side remote from the heat resistant slip layer at a coverage of 0.05 g/m$^2$ on a dry basis, and the coating was dried to form an adhesive layer. A dye layer was formed on the adhesive layer in the same manner as in Example B1. Thus, a thermal transfer sheet of Example B7 was prepared.

| <Liquid composition B1 for adhesive layer> | |
|---|---|
| Polyvinylpyrrolidone resin (K-90, manufactured by ISP Ltd.) | 9.5 parts |
| Xylitol (Xylite XC manufactured by Towa Chemical Industry Co., Ltd.) | 0.5 part |
| Water | 83 parts |
| Isopropyl alcohol | 83 parts |

Example B8

The same substrate of PET film as used in Example B1 was provided. A heat resistant slip layer as described in Example B1 was previously formed on the other side of the substrate. A liquid composition for an adhesive layer having the following composition was gravure coated onto the substrate on its side remote from the heat resistant slip layer at a coverage of 0.2 g/m$^2$ on a dry basis, and the coating was dried to form an adhesive layer. A dye layer was formed on the adhesive layer in the same manner as in Example B1. Thus, a thermal transfer sheet of Example B8 was prepared.

Example B9

The same substrate of PET film as used in Example B1 was provided. A heat resistant slip layer as described in Example B1 was previously formed on the other side of the substrate. A liquid composition B8 for an adhesive layer having the following composition was gravure coated onto the substrate on its side remote from the heat resistant slip layer at a coverage of 0.06 g/m$^2$ on a dry basis, and the coating was dried to form an adhesive layer. A dye layer was formed on the adhesive layer in the same manner as in Example B1. Thus, a thermal transfer sheet of Example B9 was prepared.

| <Liquid composition B8 for adhesive layer> | |
|---|---|
| Polyvinylpyrrolidone resin (K-90, manufactured by ISP Ltd.) | 9.0 parts |
| Xylitol (Xylite XC manufactured by Towa Chemical Industry Co., Ltd.) | 1.0 part |
| Water | 83 parts |
| Isopropyl alcohol | 83 parts |

Example B10

The same substrate of PET film as used in Example B1 was provided. A heat resistant slip layer as described in Example B1 was previously formed on the other side of the substrate. A liquid composition B9 for an adhesive layer having the following composition was gravure coated onto the substrate on its side remote from the heat resistant slip layer at a coverage of 0.06 g/m$^2$ on a dry basis, and the coating was dried to form an adhesive layer. A dye layer was formed on the adhesive layer in the same manner as in Example B1. Thus, a thermal transfer sheet of Example B10 was prepared.

| <Liquid composition B9 for adhesive layer> | |
|---|---|
| Polyvinylpyrrolidone resin (K-90, manufactured by ISP Ltd.) | 9.9 parts |
| D-Mannitol (Mrine Crystal, manufactured by Towa Chemical Industry Co., Ltd.) | 0.1 part |
| Water | 83 parts |
| Isopropyl alcohol | 83 parts |

Example B11

The same substrate of PET film as used in Example B1 was provided. A heat resistant slip layer as described in Example B1 was previously formed on the other side of the substrate. A liquid composition B10 for an adhesive layer having the following composition was gravure coated onto the substrate on its side remote from the heat resistant slip layer at a coverage of 0.06 g/m$^2$ on a dry basis, and the coating was dried to form an adhesive layer. A dye layer was formed on the adhesive layer in the same manner as in Example B1. Thus, a thermal transfer sheet of Example B11 was prepared.

| <Liquid composition B10 for adhesive layer> | |
|---|---|
| Polyvinylpyrrolidone resin (K-90, manufactured by ISP Ltd.) | 8.0 parts |
| D-Mannitol (Marine Crystal, manufactured by Towa Chemical Industry Co., Ltd.) | 2.0 parts |
| Water | 83 parts |
| Isopropyl alcohol | 83 parts |

Example B12

The same substrate of PET film as used in Example B1 was provided. A heat resistant slip layer as described in Example B1 was previously formed on the other side of the substrate. A liquid composition B11 for an adhesive layer having the following composition was gravure coated onto the substrate on its side remote from the heat resistant slip layer at a coverage of 0.06 g/m$^2$ on a dry basis, and the coating was dried to form an adhesive layer. A dye layer was formed on the adhesive layer in the same manner as in Example B1. Thus, a thermal transfer sheet of Example B12 was prepared.

| <Liquid composition B11 for adhesive layer> | |
|---|---|
| Polyvinylpyrrolidone resin (K-90, manufactured by ISP Ltd.) | 9.9 parts |
| Reducing maltose (Amalty MR50, manufactured by Towa Chemical Industry Co., Ltd.) | 0.1 part |
| Water | 83 parts |
| Isopropyl alcohol | 83 parts |

Example B13

The same substrate of PET film as used in Example B1 was provided. A heat resistant slip layer as described in Example B1 was previously formed on the other side of the substrate. A liquid composition B12 for an adhesive layer having the following composition was gravure coated onto the substrate on its side remote from the heat resistant slip layer at a coverage of 0.06 g/m$^2$ on a dry basis, and the coating was dried to form an adhesive layer. A dye layer was formed on the adhesive layer in the same manner as in Example B1. Thus, a thermal transfer sheet of Example B13 was prepared.

| <Liquid composition B12 for adhesive layer> | |
|---|---|
| Polyvinylpyrrolidone resin (K-90, manufactured by ISP Ltd.) | 8.0 parts |
| Reducing maltose (Amalty MR50, manufactured by Towa Chemical Industry Co., Ltd.) | 2.0 parts |
| Water | 83 parts |
| Isopropyl alcohol | 83 parts |

Example B14

The same substrate of PET film as used in Example B1 was provided. A heat resistant slip layer as described in Example B1 was previously formed on the other side of the substrate. A liquid composition B13 for an adhesive layer having the following composition was gravure coated onto the substrate on its side remote from the heat resistant slip layer at a coverage of 0.06 g/m$^2$ on a dry basis, and the coating was dried to form an adhesive layer. A dye layer was formed on the adhesive layer in the same manner as in Example B1. Thus, a thermal transfer sheet of Example B14 was prepared.

| <Liquid composition B13 for adhesive layer> | |
|---|---|
| Polyvinylpyrrolidone resin (K-90, manufactured by ISP Ltd.) | 9.9 parts |
| D-Sorbitol (LTS-P50M, manufactured by Towa Chemical Industry Co., Ltd.) | 0.1 part |
| Water | 83 parts |
| Isopropyl alcohol | 83 parts |

Example B15

The same substrate of PET film as used in Example B1 was provided. A heat resistant slip layer as described in Example B1 was previously formed on the other side of the substrate. A liquid composition B14 for an adhesive layer having the following composition was gravure coated onto the substrate on its side remote from the heat resistant slip layer at a coverage of 0.06 g/m$^2$ on a dry basis, and the coating was dried to form an adhesive layer. A dye layer was formed on the adhesive layer in the same manner as in Example B1. Thus, a thermal transfer sheet of Example B15 was prepared.

| <Liquid composition B14 for adhesive layer> | |
|---|---|
| Polyvinylpyrrolidone resin (K-90, manufactured by ISP Ltd.) | 8.0 parts |
| D-Sorbitol (LTS-P50M, manufactured by Towa Chemical Industry Co., Ltd.) | 2.0 parts |
| Water | 83 parts |
| Isopropyl alcohol | 83 parts |

Example B16

The same substrate of PET film as used in Example B1 was provided. A heat resistant slip layer as described in Example B1 was previously formed on the other side of the substrate. A liquid composition B15 for an adhesive layer having the following composition was gravure coated onto the substrate on its side remote from the heat resistant slip layer at a coverage of 0.06 g/m$^2$ on a dry basis, and the coating was dried to form an adhesive layer. A dye layer was formed on the adhesive layer in the same manner as in Example B1. Thus, a thermal transfer sheet of Example B16 was prepared.

| <Liquid composition B15 for adhesive layer> | |
|---|---|
| Polyvinylpyrrolidone resin (K-90, manufactured by ISP Ltd.) | 9.9 parts |
| Xylitol (Xylite XC, manufactured by Towa Chemical Industry Co., Ltd.) | 0.1 part |
| Water | 83 parts |
| Isopropyl alcohol | 83 parts |

Example B17

The same substrate of PET film as used in Example B1 was provided. A heat resistant slip layer as described in Example B1 was previously formed on the other side of the substrate. The liquid composition for an adhesive layer as used in Example B7 was gravure coated onto the substrate on its side remote from the heat resistant slip layer at a coverage of 0.03 g/m$^2$ on a dry basis, and the coating was dried to form an adhesive layer. A dye layer was formed on the adhesive layer in the same manner as in Example B1. Thus, a thermal transfer sheet of Example B17 was prepared.

Example B18

The same substrate of PET film as used in Example B1 was provided. A heat resistant slip layer as described in Example B1 was previously formed on the other side of the substrate. The liquid composition for an adhesive layer as used in Example B7 was gravure coated onto the substrate on its side remote from the heat resistant slip layer at a coverage of 0.35 g/m$^2$ on a dry basis, and the coating was dried to form an adhesive layer. A dye layer was formed on the adhesive layer in the same manner as in Example B1. Thus, a thermal transfer sheet of Comparative Example B18 was prepared.

Example B19

The same substrate of PET film as used in Example B1 was provided. A heat resistant slip layer as described in Example B1 was previously formed on the other side of the substrate. A liquid composition B16 for an adhesive layer having the following composition was gravure coated onto the substrate on its side remote from the heat resistant slip layer at a coverage of 0.06 g/m$^2$ on a dry basis, and the coating was dried to form an adhesive layer. A dye layer was formed on the adhesive layer in the same manner as in Example B1. Thus, a thermal transfer sheet of Example B19 was prepared.

| <Liquid composition B16 for adhesive layer> | |
|---|---|
| Polyvinylpyrrolidone resin (K-90, manufactured by ISP Ltd.) | 8.0 parts |
| Xylitol (Xylite XC, manufactured by Towa Chemical Industry Co., Ltd.) | 2.0 parts |
| Water | 83 parts |
| Isopropyl alcohol | 83 parts |

Comparative Example B1

The same substrate of PET film as used in Example B1 was provided. A heat resistant slip layer as described in Example B1 was previously formed on the other side of the substrate. A liquid composition B17 for an adhesive layer having the following composition was gravure coated onto the substrate on its side remote from the heat resistant slip layer at a coverage of 0.06 g/m$^2$ on a dry basis, and the coating was dried to form an adhesive layer. A dye layer was formed on the adhesive layer in the same manner as in Example B1. Thus, a thermal transfer sheet of Comparative Example B1 was prepared.

| <Liquid composition B17 for adhesive layer> | |
|---|---|
| Polyvinylpyrrolidone resin (K-90, manufactured by ISP Ltd.) | 10 parts |
| Water | 83 parts |
| Isopropyl alcohol | 83 parts |

Evaluation Test B

The thermal transfer sheets of Example B and Comparative Example B were evaluated for heat-resistant adhesion at room temperature and under high-temperature and high-humidity conditions and adhesion to an image-receiving sheet by the following methods.

(Heat Resistant Adhesion 1)

Each of the thermal transfer sheets of Example B and Comparative Example B as a sample was applied onto a mount so that the dye layer surface faced upward, that is, the mount was brought into contact with the heat resistant slip layer. A reference ribbon 1 (an assembly comprising a dye layer, which is the same as that in the sample, provided directly on an easy-adhesion treated PET film of DIAFOIL K230E manufactured by MITSUBISHI POLYESTER FILM CORPORATION as a substrate) corresponding to the sample was applied onto the identical mount at its position different from the position of the sample so that the surface of the dye layer faced upward. Each mount was folded back so that dye layer surface in the sample and the dye layer surface in the reference ribbon were put on top of and brought into contact with each other. In this state, heat sealing was carried out under conditions of temperature 100 to 130° C., pressure 34.3×10$^4$ Pa, and pressing time 2 sec, followed by separation. The assembly was then visually inspected for residual dye layer (undesired transfer of dye layer) in each of the sample and the reference ribbon 1. The results were evaluated according to the following criteria. In this case, the heat resistant adhesion test was carried out by the following two testing methods. In one of the testing methods, the heat sealing was carried out in such a state that both the thermal transfer sheets of Example B and Comparative Example B as samples and the reference ribbon 1 were allowed to stand at room temperature. In the other testing method, the heat sealing was carried out after both the sample thermal transfer sheets and the reference ribbon 1 were allowed to stand under an environment of 40° C. and 90% RH for 16 hr.

Evaluation Criteria

○: The area of the dye layer remaining on the sample side is larger than the area of the dye layer remaining on the reference ribbon side.

Δ: The area of the dye layer remaining on the sample side is equal to the area of the dye layer remaining on the reference ribbon side.

x: The area of the dye layer remaining on the sample side is smaller than the area of the dye layer remaining on the reference ribbon side.

(Heat Resistant Adhesion 2)

Each of the thermal transfer sheets of Example B and Comparative Example B as a sample was applied onto a mount so that the dye layer surface faced upward, that is, the mount was brought into contact with the heat resistant slip layer. A reference ribbon 2 (an assembly comprising a dye layer, which is the same as that in the sample, provided on a substrate comprising an adhesive layer formed of a polyvinylpyrrolidone resin (K-90, manufactured by ISP Ltd.) (the same as the adhesive layer in Comparative Example B1) provided at a coverage of 0.06 g/m$^2$ on a dry basis on a surface of a PET film of DIAFOIL K880 manufactured by MITSUBISHI POLYESTER FILM CORPORATION as a substrate) corresponding to the sample was applied onto the identical mount at its position different from the position of the sample so that the surface of the dye layer faced upward. Each mount was folded back so that dye layer surface in the sample and the dye layer surface in the reference ribbon were put on top of and brought into contact with each other. In this state, heat sealing was carried out under conditions of temperature 100 to 130° C., pressure 34.3×10$^4$ Pa, and pressing time 2 sec, followed by separation. The assembly was then visually inspected for residual dye layer (undesired transfer of dye layer) in each of the sample and the reference ribbon 2. The results were evaluated according to the same criteria as the heat resistant adhesion 1. In this case, the heat resistant adhesion test was carried out by the following two testing methods. In one of the testing methods, the heat sealing was carried out in such a state that both the thermal transfer sheets of Example B and Comparative Example B as samples and the reference ribbon 2 were allowed to stand at room temperature. In the other testing method, the heat sealing was carried out after both the sample thermal transfer sheets and the reference ribbon 2 were allowed to stand under an environment of 40° C. and 90% RH for 16 hr.

(Adhesion to Image Receiving Sheet)

Each of the thermal transfer sheets of Example B and Comparative Example B and a specialty standard set of an image receiving sheet for a digital color printer P-200, manufactured by Olympus Optical Co., LTD. were put on top of each other so that the dye layer surface in the thermal transfer sheet was brought into contact with the image receiving surface in the image receiving sheet. The assembly was heat sealed under conditions of temperature 100 to 130° C., pressure $34.3\times10^4$ Pa, and pressing time 2 sec. Thereafter, both the sheets were separated from each other and were visually inspected for the state of separation between the dye layer in the sample and the image receiving layer in the image receiving sheet, and the results were evaluated according to the following criteria. In this case, the heat sealing of the thermal transfer sheet and the image receiving sheet was carried out in such a state that these sheets were allowed to stand at room temperature.

Evaluation Criteria

○: No abnormal transfer of image receiving layer onto dye layer side took place.

x: Abnormal transfer of image receiving layer onto dye layer side took place.

The results of evaluation of each item will be shown in Table 2 below

TABLE 2

| | Addition amount of saccharide or sugar alcohol *1 | Coverage, g/m | Heat resistant adhesion 1 Room temp. | Heat resistant adhesion 1 High temp. and high humidity conditions | Heat resistant adhesion 2 Room temp. | Heat resistant adhesion 2 High temp. and high humidity conditions | Adhesion to image receiving sheet |
|---|---|---|---|---|---|---|---|
| Example B1 | 5% | 0.06 | ○ | ○ | Δ | ○ | ○ |
| Example B2 | 10% | 0.06 | ○ | ○ | Δ | ○ | ○ |
| Example B3 | 5% | 0.06 | ○ | ○ | Δ | ○ | ○ |
| Example B4 | 10% | 0.06 | ○ | ○ | Δ | ○ | ○ |
| Example B5 | 5% | 0.06 | ○ | ○ | Δ | ○ | ○ |
| Example B6 | 10% | 0.06 | ○ | ○ | Δ | ○ | ○ |
| Example B7 | 5% | 0.05 | ○ | ○ | ○ | ○ | ○ |
| Example B8 | 5% | 0.2 | ○ | ○ | ○ | ○ | ○ |
| Example B9 | 10% | 0.06 | ○ | ○ | ○ | ○ | ○ |
| Example B10 | 1% | 0.06 | ○ | X | Δ | ○ | ○ |
| Example B11 | 20% | 0.06 | ○ | ○ | X | ○ | ○ |
| Example B12 | 1% | 0.06 | ○ | X | Δ | ○ | ○ |
| Example B13 | 20% | 0.06 | ○ | ○ | X | ○ | ○ |
| Example B14 | 1% | 0.06 | ○ | X | Δ | ○ | ○ |
| Example B15 | 20% | 0.06 | ○ | ○ | X | ○ | ○ |
| Example B16 | 1% | 0.06 | ○ | X | Δ | ○ | ○ |
| Example B17 | 5% | 0.03 | ○ | X | Δ | ○ | ○ |
| Example B18 | 5% | 0.35 | ○ | ○ | ○ | ○ | X |
| Example B19 | 20% | 0.06 | ○ | ○ | X | ○ | ○ |
| Comparative Example B1 | 0% | 0.06 | ○ | X | — | — | ○ |

*1: The addition amount of saccharide or sugar alcohol is the percentage of addition amount based on the total amount of the saccharide or sugar alcohol and the polyvinylpyrrolidone resin (K-90, manufactured by ISP Ltd.).

Third Aspect of the Present Invention

Example C1

A 4.5 μm-thick untreated polyethylene terephthalate (PET) film (DIAFOIL K 880, manufactured by Mitsubishi Polyester Film Co., Ltd.) was provided as a substrate. A liquid composition C1 having the following composition for an adhesive layer was gravure coated onto the PET film at a coverage of 0.06 g/m$^2$ on a dry basis, and the coating was dried at 110° C. for one min to form an adhesive layer. A liquid composition C having the following composition for a dye layer was then gravure coated on the adhesive layer at a coverage of 0.8 g/m$^2$ on a dry basis, and the coating was dried to form a dye layer. Thus, a thermal transfer sheet of Example C1 was prepared. In this case, a liquid composition C having the following composition for a heat resistant slip layer was previously gravure coated on the other side of the substrate at a coverage of 1.0 g/m$^2$ on a dry basis, and the coating was dried to form a heat resistant slip layer.

| <Liquid composition C1 for adhesive layer> | |
|---|---|
| Polyvinylpyrrolidone resin (K-90, manufactured by ISP Ltd.) | 9.9 parts |
| Hydrolyzable tannic acid (specialty tannic acid, manufactured by Dainippon Pharmaceutical Co. Ltd.) | 0.1 part |
| Water | 83 parts |
| Isopropyl alcohol | 83 parts |
| <Liquid composition C for dye layer> | |
| C.I. Solvent Blue 22 | 5.5 parts |
| Polyvinyl acetal resin (S-lec KS-5, manufactured by Sekisui Chemical Co., Ltd.) | 3.0 parts |
| Methyl ethyl ketone | 22.5 parts |
| Toluene | 68.2 parts |
| <Liquid composition C for heat resistant slip layer> | |
| Polyvinyl butyral resin (S-lec BX-1, manufactured by Sekisui Chemical Co., Ltd.) | 13.6 parts |
| Polyisocyanate curing agent (Takenate D 218, manufactured by Takeda Chemical Industries, Ltd.) | 0.6 part |
| Phosphoric ester (Plysurf A 208 S, manufactured by Dai-Ichi Kogyo Seiyaku Co., Ltd.) | 0.8 part |
| Methyl ethyl ketone | 42.5 parts |
| Toluene | 42.5 parts |

Example C2

The same substrate of PET film as used in Example C1 was provided. A heat resistant slip layer as described in Example C1 was previously formed on the other side of the substrate. A liquid composition C2 for an adhesive layer having the following composition was gravure coated onto the substrate on its side remote from the heat resistant slip layer at a coverage of 0.06 g/m$^2$ on a dry basis, and the coating was dried to form an adhesive layer. A dye layer was formed on the adhesive layer in the same manner as in Example C1. Thus, a thermal transfer sheet of Example C2 was prepared.

| <Liquid composition C2 for adhesive layer> | |
|---|---|
| Polyvinylpyrrolidone resin (K-90, manufactured by ISP Ltd.) | 9.5 parts |
| Hydrolyzable tannic acid (specialty tannic acid, manufactured by Dainippon Pharmaceutical Co. Ltd.) | 0.5 part |
| Water | 83 parts |
| Isopropyl alcohol | 83 parts |

Example C3

The same substrate of PET film as used in Example C1 was provided. A heat resistant slip layer as described in Example C1 was previously formed on the other side of the substrate. A liquid composition C3 for an adhesive layer having the following composition was gravure coated onto the substrate on its side remote from the heat resistant slip layer at a coverage of 0.06 g/m$^2$ on a dry basis, and the coating was dried to form an adhesive layer. A dye layer was formed on the adhesive layer in the same manner as in Example C1. Thus, a thermal transfer sheet of Example C3 was prepared.

| <Liquid composition C3 for adhesive layer> | |
|---|---|
| Polyvinylpyrrolidone resin (K-90, manufactured by ISP Ltd.) | 9.0 parts |
| Hydrolyzable tannic acid (specialty tannic acid, manufactured by Dainippon Pharmaceutical Co. Ltd.) | 1.0 part |
| Water | 83 parts |
| Isopropyl alcohol | 83 parts |

Example C4

The same substrate of PET film as used in Example C1 was provided. A heat resistant slip layer as described in Example C1 was previously formed on the other side of the substrate. A liquid composition C4 for an adhesive layer having the following composition was gravure coated onto the substrate on its side remote from the heat resistant slip layer at a coverage of 0.06 g/m$^2$ on a dry basis, and the coating was dried to form an adhesive layer. A dye layer was formed on the adhesive layer in the same manner as in Example C1. Thus, a thermal transfer sheet of Example C4 was prepared.

| <Liquid composition C4 for adhesive layer> | |
|---|---|
| Polyvinylpyrrolidone resin (K-90, manufactured by ISP Ltd.) | 9.9 parts |
| Pyrogallol derivative (manufactured by Dainippon Pharmaceutical Co. Ltd.; tradename Pyrogallol N) | 0.1 part |
| Water | 83 parts |
| Isopropyl alcohol | 83 parts |

Example C5

The same substrate of PET film as used in Example C1 was provided. A heat resistant slip layer as described in Example C1 was previously formed on the other side of the substrate. A liquid composition C5 for an adhesive layer having the following composition was gravure coated onto the substrate on its side remote from the heat resistant slip layer at a coverage of 0.05 g/m$^2$ on a dry basis, and the coating was dried to form an adhesive layer. A dye layer was formed on the adhesive layer in the same manner as in Example C1. Thus, a thermal transfer sheet of Example C5 was prepared.

| <Liquid composition C5 for adhesive layer> | |
|---|---|
| Polyvinylpyrrolidone resin (K-90, manufactured by ISP Ltd.) | 9.5 parts |
| Pyrogallol derivative (manufactured by Dainippon Pharmaceutical Co. Ltd.; tradename Pyrogallol N) | 0.5 part |
| Water | 83 parts |
| Isopropyl alcohol | 83 parts |

Example C6

The same substrate of PET film as used in Example C1 was provided. A heat resistant slip layer as described in Example C1 was previously formed on the other side of the substrate. The liquid composition for an adhesive layer as used in Example C5 was gravure coated onto the substrate on its side remote from the heat resistant slip layer at a coverage of 0.2 g/m$^2$ on a dry basis, and the coating was dried to form an adhesive layer. A dye layer was formed on the adhesive layer in the same manner as in Example C1. Thus, a thermal transfer sheet of Example C6 was prepared.

Example C7

The same substrate of PET film as used in Example C1 was provided. A heat resistant slip layer as described in Example C1 was previously formed on the other side of the substrate. A liquid composition C6 for an adhesive layer having the following composition was gravure coated onto the substrate on its side remote from the heat resistant slip layer at a coverage of 0.06 g/m$^2$ on a dry basis, and the coating was dried to form an adhesive layer. A dye layer was formed on the adhesive layer in the same manner as in Example C1. Thus, a thermal transfer sheet of Example C7 was prepared.

| <Liquid composition C6 for adhesive layer> | |
|---|---|
| Polyvinylpyrrolidone resin (K-90, manufactured by ISP Ltd.) | 9.0 parts |
| Pyrogallol derivative (manufactured by Dainippon Pharmaceutical Co. Ltd.; tradename Pyrogallol N) | 1.0 part |
| Water | 83 parts |
| Isopropyl alcohol | 83 parts |

Example C8

The same substrate of PET film as used in Example C1 was provided. A heat resistant slip layer as described in Example C1 was previously formed on the other side of the substrate. A liquid composition C7 for an adhesive layer having the following composition was gravure coated onto the substrate on its side remote from the heat resistant slip layer at a coverage of 0.06 g/m$^2$ on a dry basis, and the coating was dried to form an adhesive layer. A dye layer was formed on the adhesive layer in the same manner as in Example C1. Thus, a thermal transfer sheet of Example C8 was prepared.

| <Liquid composition C7 for adhesive layer> | |
|---|---|
| Polyvinylpyrrolidone resin (K-90, manufactured by ISP Ltd.) | 8.0 parts |
| Hydrolyzable tannic acid (specialty tannic acid, manufactured by Dainippon Pharmaceutical Co. Ltd.) | 2.0 parts |
| Water | 83 parts |
| Isopropyl alcohol | 83 parts |

Example C9

The same substrate of PET film as used in Example C1 was provided. A heat resistant slip layer as described in Example C1 was previously formed on the other side of the substrate. The liquid composition for an adhesive layer as used in Example C5 was gravure coated onto the substrate on its side remote from the heat resistant slip layer at a coverage of 0.03 g/m$^2$ on a dry basis, and the coating was dried to form an adhesive layer. A dye layer was formed on the adhesive layer in the same manner as in Example C1. Thus, a thermal transfer sheet of Example C9 was prepared.

Example C10

The same substrate of PET film as used in Example C1 was provided. A heat resistant slip layer as described in Example C1 was previously formed on the other side of the substrate. The liquid composition for an adhesive layer as used in Example C5 was gravure coated onto the substrate on its side remote from the heat resistant slip layer at a coverage of 0.35 g/m$^2$ on a dry basis, and the coating was dried to form an adhesive layer. A dye layer was formed on the adhesive layer in the same manner as in Example C1. Thus, a thermal transfer sheet of Example C10 was prepared.

Example C11

The same substrate of PET film as used in Example C1 was provided. A heat resistant slip layer as described in Example C1 was previously formed on the other side of the substrate. A liquid composition C8 for an adhesive layer having the following composition was gravure coated onto the substrate on its side remote from the heat resistant slip layer at a coverage of 0.06 g/m$^2$ on a dry basis, and the coating was dried to form an adhesive layer. A dye layer was formed on the adhesive layer in the same manner as in Example C1. Thus, a thermal transfer sheet of Example C11 was prepared.

| <Liquid composition C8 for adhesive layer> | |
|---|---|
| Polyvinylpyrrolidone resin (K-90, manufactured by ISP Ltd.) | 8.0 parts |
| Pyrogallol derivative (manufactured by Dainippon Pharmaceutical Co. Ltd.; tradename Pyrogallol N) | 2.0 parts |
| Water | 83 parts |
| Isopropyl alcohol | 83 parts |

Comparative Example C1

The same substrate of PET film as used in Example C1 was provided. A heat resistant slip layer as described in Example C1 was previously formed on the other side of the substrate. A liquid composition C9 for an adhesive layer having the following composition was gravure coated onto the substrate on its side remote from the heat resistant slip layer at a coverage of 0.06 g/m$^2$ on a dry basis, and the coating was dried to form an adhesive layer. A dye layer was formed on the adhesive layer in the same manner as in Example C1. Thus, a thermal transfer sheet of Comparative Example C1 was prepared.

| <Liquid composition C9 for adhesive layer> | |
|---|---|
| Polyvinylpyrrolidone resin (K-90, manufactured by ISP Ltd.) | 10 parts |
| Water | 83 parts |
| Isopropyl alcohol | 83 parts |

Evaluation Test C

The thermal transfer sheets of Example C and Comparative Example C were evaluated for heat-resistant adhesion at room temperature and under high-temperature and high-humidity conditions and adhesion to an image-receiving sheet by the following methods.

(Heat Resistant Adhesion 1)

Each of the thermal transfer sheets of Example C and Comparative Example C as a sample was applied onto a mount so that the dye layer surface faced upward, that is, the mount was brought into contact with the heat resistant slip layer. A reference ribbon 1 (an assembly comprising a dye layer, which is the same as that in the sample, provided directly on an easy-adhesion treated PET film of DIAFOIL K230E manufactured by MITSUBISHI POLYESTER FILM CORPORATION as a substrate) corresponding to the sample was applied onto the identical mount at its position different from the position of the sample so that the surface of the dye layer faced upward. Each mount was folded back so that dye layer surface in the sample and the dye layer surface in the reference ribbon were put on top of and brought into contact with each other. In this state, heat sealing was carried out under conditions of temperature 100 to 130° C., pressure $34.3\times10^4$ Pa, and pressing time 2 sec, followed by separation. The assembly was then visually inspected for residual dye layer (undesired transfer of dye layer) in each of the sample and the reference ribbon 1. The results were evaluated according to the following criteria. In this case, the heat resistant adhesion test was carried out by the following two testing methods. In one of the testing methods, the heat sealing was carried out in such a state that both the thermal transfer sheets of Example C and Comparative Example C as samples and the reference ribbon 1 were allowed to stand at room temperature. In the other testing method, the heat sealing was carried out after both the sample thermal transfer sheets and the reference ribbon 1 were allowed to stand under an environment of 40° C. and 90% RH for 16 hr.

Evaluation Criteria

○: The area of the dye layer remaining on the sample side is larger than the area of the dye layer remaining on the reference ribbon side.

Δ: The area of the dye layer remaining on the sample side is equal to the area of the dye layer remaining on the reference ribbon side.

x: The area of the dye layer remaining on the sample side is smaller than the area of the dye layer remaining on the reference ribbon side.

(Heat Resistant Adhesion 2)

Each of the thermal transfer sheets of Example C and Comparative Example C as a sample was applied onto a mount so that the dye layer surface faced upward, that is, the mount was brought into contact with the heat resistant slip layer. A reference ribbon 2 (an assembly comprising a dye layer, which is the same as that in the sample, provided on a substrate comprising an adhesive layer formed of a polyvinylpyrrolidone resin (K-90, manufactured by ISP Ltd.) (the same as the adhesive layer in Comparative Example C1) provided at a coverage of 0.06 g/m$^2$ on a dry basis on a surface of a PET film of DIAFOIL K880 manufactured by MITSUBISHI POLYESTER FILM CORPORATION as a substrate) corresponding to the sample was applied onto the identical mount at its position different from the position of the sample so that the surface of the dye layer faced upward. Each mount was folded back so that dye layer surface in the sample and the dye layer surface in the reference ribbon were put on top of and brought into contact with each other. In this state, heat sealing was carried out under conditions of temperature 100 to 130° C., pressure $34.3\times10^4$ Pa, and pressing time 2 sec, followed by separation. The assembly was then visually inspected for residual dye layer (undesired transfer of dye layer) in each of the sample and the reference ribbon 2. The results were evaluated according to the same criteria as the heat resistant adhesion 1. In this case, the heat resistant adhesion test was carried out by the following two testing methods. In one of the testing methods, the heat sealing was carried out in such a state that both the thermal transfer sheets of Example C and Comparative Example C as samples and the reference ribbon 2 were allowed to stand at room temperature. In the other testing method, the heat sealing was carried out after both the sample thermal transfer sheets and the reference ribbon 2 were allowed to stand under an environment of 40° C. and 90% RH for 16 hr.

(Adhesion to Image Receiving Sheet)

Each of the thermal transfer sheets of Example C and Comparative Example C and a specialty standard set of an image receiving sheet for a digital color printer P-200, manufactured by Olympus Optical Co., LTD. were put on top of each other so that the dye layer surface in the thermal transfer sheet was brought into contact with the image receiving surface in the image receiving sheet. The assembly was heat sealed under conditions of temperature 100 to 130° C., pressure $34.3\times10^4$ Pa, and pressing time 2 sec. Thereafter, both the sheets were separated from each other and were visually inspected for the state of separation between the dye layer in the sample and the image receiving layer in the image receiving sheet, and the results were evaluated according to the following criteria. In this case, the heat sealing of the thermal transfer sheet and the image receiving sheet was carried out in such a state that these sheets were allowed to stand at room temperature.

Evaluation Criteria

○: No abnormal transfer of image receiving layer onto dye layer side took place.

x: Abnormal transfer of image receiving layer onto dye layer side took place.

The results of evaluation of each item will be shown in Table 3 below

TABLE 3

| | Addition amount of complex forming agent *1 | Coverage, g/m | Heat resistant adhesion 1 Room temp. | Heat resistant adhesion 1 High temp. and high humidity conditions | Heat resistant adhesion 2 Room temp. | Heat resistant adhesion 2 High temp. and high humidity conditions | Adhesion to image receiving sheet |
|---|---|---|---|---|---|---|---|
| Example C1 | 1% | 0.06 | ○ | ○ | Δ | ○ | ○ |
| Example C2 | 5% | 0.06 | ○ | ○ | Δ | ○ | ○ |
| Example C3 | 10% | 0.06 | ○ | ○ | Δ | ○ | ○ |
| Example C4 | 1% | 0.06 | ○ | ○ | Δ | ○ | ○ |
| Example C5 | 5% | 0.05 | ○ | ○ | Δ | ○ | ○ |
| Example C6 | 5% | 0.2 | ○ | ○ | ○ | ○ | ○ |
| Example C7 | 10% | 0.06 | ○ | ○ | Δ | ○ | ○ |
| Example C8 | 20% | 0.06 | ○ | ○ | X | ○ | ○ |
| Example C9 | 5% | 0.03 | ○ | X | Δ | ○ | ○ |
| Example C10 | 5% | 0.35 | ○ | ○ | ○ | ○ | X |
| Example C11 | 20% | 0.06 | ○ | ○ | X | ○ | ○ |
| Comparative Example C1 | 0% | 0.06 | ○ | X | — | — | ○ |

*1: The addition amount of complex forming agent is the percentage of addition amount based on the total amount of the complex forming agent and the polyvinylpyrrolidone resin (K-90, manufactured by ISP Ltd.).

Fourth Aspect of the Present Invention

Example D1

A 4.5 μm-thick untreated polyethylene terephthalate (PET) film (DIAFOIL K 880, manufactured by Mitsubishi Polyester Film Co., Ltd.) was provided as a substrate. A liquid composition D1 having the following composition for an adhesive layer was gravure coated onto the PET film at a coverage of 0.06 g/m$^2$ on a dry basis, and the coating was dried at 110° C. for one min to form an adhesive layer. A liquid composition D having the following composition for a dye layer was then gravure coated on the adhesive layer at a coverage of 0.8 g/m$^2$ on a dry basis, and the coating was dried to form a dye layer. Thus, a thermal transfer sheet of Example D1 was prepared. In this case, a liquid composition D having the following composition for a heat resistant slip layer was previously gravure coated on the other side of the substrate at a coverage of 1.0 g/m$^2$ on a dry basis, and the coating was dried to form a heat resistant slip layer.

| <Liquid composition D1 for adhesive layer> | |
|---|---|
| Polyvinylpyrrolidone resin (K-90, manufactured by ISP Ltd.) | 9.9 parts |
| Shellac resin (LAC-COAT 50, manufactured by THE JAPAN SHELLAC INDUSTRIES, LTD.) | 0.1 part |
| Methyl ethyl ketone | 83 parts |
| Isopropyl alcohol | 83 parts |

-continued

| <Liquid composition D for dye layer> | |
|---|---|
| C.I. Solvent Blue 22 | 5.5 parts |
| Polyvinyl acetal resin (S-lec KS-5, manufactured by Sekisui Chemical Co., Ltd.) | 3.0 parts |
| Methyl ethyl ketone | 22.5 parts |
| Toluene | 68.2 parts |
| <Liquid composition D for heat resistant slip layer> | |
| Polyvinyl butyral resin (S-lec BX-1, manufactured by Sekisui Chemical Co., Ltd.) | 13.6 parts |
| Polyisocyanate curing agent (Takenate D 218, manufactured by Takeda Chemical Industries, Ltd.) | 0.6 part |
| Phosphoric ester (Plysurf A 208 S, manufactured by Dai-Ichi Kogyo Seiyaku Co., Ltd.) | 0.8 part |
| Methyl ethyl ketone | 42.5 parts |
| Toluene | 42.5 parts |

Example D2

The same substrate of PET film as used in Example D1 was provided. A heat resistant slip layer as described in Example D1 was previously formed on the other side of the substrate. A coating liquid D2 for an adhesive layer having the following composition was gravure coated onto the substrate on its side remote from the heat resistant slip layer at a coverage of 0.06 g/m$^2$ on a dry basis, and the coating was dried to form an adhesive layer. A dye layer was formed on the adhesive layer in the same manner as in Example D1. Thus, a thermal transfer sheet of Example D2 was prepared.

| <Liquid composition D2 for adhesive layer> | |
|---|---|
| Polyvinylpyrrolidone resin (K-90, manufactured by ISP Ltd.) | 9.5 parts |
| Shellac resin (LAC-COAT 50, manufactured by THE JAPAN SHELLAC INDUSTRIES, LTD.) | 0.5 part |
| Methyl ethyl ketone | 83 parts |
| Isopropyl alcohol | 83 parts |

Example D3

The same substrate of PET film as used in Example D1 was provided. A heat resistant slip layer as described in Example D1 was previously formed on the other side of the substrate. A coating liquid D3 for an adhesive layer having the following composition was gravure coated onto the substrate on its side remote from the heat resistant slip layer at a coverage of 0.06 g/m$^2$ on a dry basis, and the coating was dried to form an adhesive layer. A dye layer was formed on the adhesive layer in the same manner as in Example D1. Thus, a thermal transfer sheet of Example D3 was prepared.

| <Liquid composition D3 for adhesive layer> | |
|---|---|
| Polyvinylpyrrolidone resin (K-90, manufactured by ISP Ltd.) | 9.0 parts |
| Shellac resin (LAC-COAT 50, manufactured by THE JAPAN SHELLAC INDUSTRIES, LTD.) | 1.0 part |
| Methyl ethyl ketone | 83 parts |
| Isopropyl alcohol | 83 parts |

Example D4

The same substrate of PET film as used in Example D1 was provided. A heat resistant slip layer as described in Example D1 was previously formed on the other side of the substrate. A coating liquid D4 for an adhesive layer having the following composition was gravure coated onto the substrate on its side remote from the heat resistant slip layer at a coverage of 0.06 g/m$^2$ on a dry basis, and the coating was dried to form an adhesive layer. A dye layer was formed on the adhesive layer in the same manner as in Example D1. Thus, a thermal transfer sheet of Example D4 was prepared.

| <Liquid composition D4 for adhesive layer> | |
|---|---|
| Polyvinylpyrrolidone resin (K-90, manufactured by ISP Ltd.) | 9.9 parts |
| Cellulose acetate propionate resin (CAP 482-0.5, manufactured by E. KoDak Co. | 0.1 part |
| Methyl ethyl ketone | 83 parts |
| Isopropyl alcohol | 83 parts |

Example D5

The same substrate of PET film as used in Example D1 was provided. A heat resistant slip layer as described in Example D1 was previously formed on the other side of the substrate. A coating liquid D5 for an adhesive layer having the following composition was gravure coated onto the substrate on its side remote from the heat resistant slip layer at a coverage of 0.05 g/m$^2$ on a dry basis, and the coating was dried to form an adhesive layer. A dye layer was formed on the adhesive layer in the same manner as in Example D1. Thus, a thermal transfer sheet of Example D5 was prepared.

| <Liquid composition D5 for adhesive layer> | |
|---|---|
| Polyvinylpyrrolidone resin (K-90, manufactured by ISP Ltd.) | 9.5 parts |
| Cellulose acetate propionate resin (CAP 482-0.5, manufactured by E. KoDak Co. | 0.5 part |
| Methyl ethyl ketone | 83 parts |
| Isopropyl alcohol | 83 parts |

Example D6

The same substrate of PET film as used in Example D1 was provided. A heat resistant slip layer as described in Example D1 was previously formed on the other side of the substrate. The coating liquid for an adhesive layer as used in Example D5 was gravure coated onto the substrate on its side remote from the heat resistant slip layer at a coverage of 0.2 g/m$^2$ on a dry basis, and the coating was dried to form an adhesive layer. A dye layer was formed on the adhesive layer in the same manner as in Example D1. Thus, a thermal transfer sheet of Example D6 was prepared.

Example D7

The same substrate of PET film as used in Example D1 was provided. A heat resistant slip layer as described in Example D1 was previously formed on the other side of the substrate. A coating liquid D6 for an adhesive layer having the following composition was gravure coated onto the substrate on its side remote from the heat resistant slip layer at a coverage of 0.06 g/m$^2$ on a dry basis, and the coating was dried to form an adhesive layer. A dye layer was formed on the adhesive layer in the same manner as in Example D1. Thus, a thermal transfer sheet of Example D7 was prepared.

| <Liquid composition D6 for adhesive layer> | |
|---|---|
| Polyvinylpyrrolidone resin (K-90, manufactured by ISP Ltd.) | 9.0 parts |
| Cellulose acetate propionate resin (CAP 482-0.5, manufactured by E. KoDak Co. | 1.0 part |
| Methyl ethyl ketone | 83 parts |
| Isopropyl alcohol | 83 parts |

Example D8

The same substrate of PET film as used in Example D1 was provided. A heat resistant slip layer as described in Example D1 was previously formed on the other side of the substrate. A coating liquid D7 for an adhesive layer having the following composition was gravure coated onto the substrate on its side remote from the heat resistant slip layer at a coverage of 0.06 g/m$^2$ on a dry basis, and the coating was dried to form an adhesive layer. A dye layer was formed on the adhesive layer in the same manner as in Example D1. Thus, a thermal transfer sheet of Example D8 was prepared.

| <Liquid composition D7 for adhesive layer> | |
|---|---|
| Polyvinylpyrrolidone resin (K-90, manufactured by ISP Ltd.) | 8.0 parts |
| Shellac resin (LAC-COAT 50, manufactured by THE JAPAN SHELLAC INDUSTRIES, LTD.) | 2.0 parts |
| Methyl ethyl ketone | 83 parts |
| Isopropyl alcohol | 83 parts |

Example D9

The same substrate of PET film as used in Example D1 was provided. A heat resistant slip layer as described in Example D1 was previously formed on the other side of the substrate. The coating liquid for an adhesive layer as used in Example D5 was gravure coated onto the substrate on its side remote from the heat resistant slip layer at a coverage of 0.03 g/m$^2$ on a dry basis, and the coating was dried to form an adhesive layer. A dye layer was formed on the adhesive layer in the same manner as in Example D1. Thus, a thermal transfer sheet of Example D9 was prepared.

Example D10

The same substrate of PET film as used in Example D1 was provided. A heat resistant slip layer as described in Example D1 was previously formed on the other side of the substrate. The coating liquid for an adhesive layer as used in Example D5 was gravure coated onto the substrate on its side remote from the heat resistant slip layer at a coverage of 0.35 g/m$^2$ on a dry basis, and the coating was dried to form an adhesive layer. A dye layer was formed on the adhesive layer in the same manner as in Example D1. Thus, a thermal transfer sheet of Example D10 was prepared.

Example D11

The same substrate of PET film as used in Example D1 was provided. A heat resistant slip layer as described in Example D1 was previously formed on the other side of the substrate. A coating liquid D8 for an adhesive layer having the following composition was gravure coated onto the substrate on its side remote from the heat resistant slip layer at a coverage of 0.06 g/m$^2$ on a dry basis, and the coating was dried to form an adhesive layer. A dye layer was formed on the adhesive layer in the same manner as in Example D1. Thus, a thermal transfer sheet of Example D11 was prepared.

| <Liquid composition D8 for adhesive layer> | |
|---|---|
| Polyvinylpyrrolidone resin (K-90, manufactured by ISP Ltd.) | 8.0 parts |
| Cellulose acetate propionate resin (CAP 482-0.5, manufactured by E. KoDak Co. | 2.0 parts |
| Methyl ethyl ketone | 83 parts |
| Isopropyl alcohol | 83 parts |

Comparative Example D1

The same substrate of PET film as used in Example D1 was provided. A heat resistant slip layer as described in Example D1 was previously formed on the other side of the substrate. A coating liquid D9 for an adhesive layer having the following composition was gravure coated onto the substrate on its side remote from the heat resistant slip layer at a coverage of 0.06 g/m$^2$ on a dry basis, and the coating was dried to form an adhesive layer. A dye layer was formed on the adhesive layer in the same manner as in Example D1. Thus, a thermal transfer sheet of Comparative Example D1 was prepared.

| <Liquid composition D9 for adhesive layer> | |
|---|---|
| Polyvinylpyrrolidone resin (K-90, manufactured by ISP Ltd.) | 10 parts |
| Methyl ethyl ketone | 83 parts |
| Isopropyl alcohol | 83 parts |

Evaluation Test D

The thermal transfer sheets of Example D and Comparative Example D were evaluated for heat-resistant adhesion at room temperature and under high-temperature and high-humidity conditions and adhesion to an image-receiving sheet by the following methods.

(Heat Resistant Adhesion 1)

Each of the thermal transfer sheets of Example D and Comparative Example D as a sample was applied onto a mount so that the dye layer surface faced upward, that is, the mount was brought into contact with the heat resistant slip layer. A reference ribbon 1 (an assembly comprising a dye layer, which is the same as that in the sample, provided directly on an easy-adhesion treated PET film of DIAFOIL K230E manufactured by MITSUBISHI POLYESTER FILM CORPORATION as a substrate) corresponding to the sample was applied onto the identical mount at its position different from the position of the sample so that the surface of the dye layer faced upward. Each mount was folded back so that dye layer surface in the sample and the dye layer surface in the reference ribbon were put on top of and brought into contact with each other. In this state, heat sealing was carried out under conditions of temperature 100 to 130° C., pressure 34.3×10$^4$ Pa, and pressing time 2 sec, followed by separation. The assembly was then visually inspected for residual dye layer (undesired transfer of dye layer) in each of the sample and the reference ribbon 1. The results were evaluated according to the following criteria. In this case, the heat resistant adhesion test was carried out by the following two testing methods. In one of the testing methods, the heat sealing was carried out in such a state that both the thermal transfer sheets of Example D and Comparative Example D as samples and the reference ribbon 1 were allowed to stand at room temperature. In the other testing method, the heat sealing was carried out after both the sample thermal transfer sheets and the reference ribbon 1 were allowed to stand under an environment of 40° C. and 90% RH for 16 hr.

Evaluation Criteria

○: The area of the dye layer remaining on the sample side is larger than the area of the dye layer remaining on the reference ribbon side.

Δ: The area of the dye layer remaining on the sample side is equal to the area of the dye layer remaining on the reference ribbon side.

x: The area of the dye layer remaining on the sample side is smaller than the area of the dye layer remaining on the reference ribbon side.

(Heat Resistant Adhesion 2)

Each of the thermal transfer sheets of Example D and Comparative Example D as a sample was applied onto a mount so that the dye layer surface faced upward, that is, the mount was brought into contact with the heat resistant slip layer. A reference ribbon 2 (an assembly comprising a dye layer, which is the same as that in the sample, provided on a substrate comprising an adhesive layer formed of a polyvinylpyrrolidone resin (K-90, manufactured by ISP Ltd.) (the same as the adhesive layer in Comparative Example D1) provided at a coverage of 0.06 g/m$^2$ on a dry basis on a surface of a PET film of DIAFOIL K880 manufactured by MITSUBISHI POLYESTER FILM CORPORATION as a substrate) corresponding to the sample was applied onto the identical mount at its position different from the position of the sample so that the surface of the dye layer faced upward. Each mount was folded back so that dye layer surface in the sample and the dye layer surface in the reference ribbon were put on top of and brought into contact with each other. In this state, heat sealing was carried out under conditions of temperature 100 to 130° C., pressure 34.3×10$^4$ Pa, and pressing time 2 sec, followed by separation. The assembly was then visually inspected for residual dye layer (undesired transfer of dye layer) in each of the sample and the reference ribbon 2. The results were evaluated according to the same criteria as the heat resistant adhesion 1. In this case, the heat resistant adhesion test was carried out by the following two testing methods. In one of the testing methods, the heat sealing was carried out in such a state that both the thermal transfer sheets of Example D and Comparative Example D as samples and the reference ribbon 2 were allowed to stand at room temperature. In the other testing method, the heat sealing was carried out after both the sample thermal transfer sheets and the reference ribbon 2 were allowed to stand under an environment of 40° C. and 90% RH for 16 hr.

(Adhesion to Image Receiving Sheet)

Each of the thermal transfer sheets of Example D and Comparative Example D and a specialty standard set of an image receiving sheet for a digital color printer P-200, manufactured by Olympus Optical Co., LTD. were put on top of each other so that the dye layer surface in the thermal transfer sheet was brought into contact with the image receiving surface in the image receiving sheet. The assembly was heat sealed under conditions of temperature 100 to 130° C., pressure 34.3×10$^4$ Pa, and pressing time 2 sec. Thereafter, both the sheets were separated from each other and were visually inspected for the state of separation between the dye layer in the sample and the image receiving layer in the image receiving sheet, and the results were evaluated according to the following criteria. In this case, the heat sealing of the thermal transfer sheet and the image receiving sheet was carried out in such a state that these sheets were allowed to stand at room temperature.

Evaluation Criteria

○: No abnormal transfer of image receiving layer onto dye layer side took place.

x: Abnormal transfer of image receiving layer onto dye layer side took place.

The results of evaluation of each item are shown in Table 4 below.

TABLE 4

| | | | Heat resistant adhesion 1 | | Heat resistant adhesion 2 | | Adhesion |
|---|---|---|---|---|---|---|---|
| | Addition amount of modifying agent *1 | Coverage, g/m | Room temp. | High temp. and high humidity conditions | Room temp. | High temp. and high humidity conditions | to image receiving sheet |
| Example D1 | 1% | 0.06 | ○ | ○ | Δ | ○ | ○ |
| Example D2 | 5% | 0.06 | ○ | ○ | Δ | ○ | ○ |
| Example D3 | 10% | 0.06 | ○ | ○ | Δ | ○ | ○ |
| Example D4 | 1% | 0.06 | ○ | ○ | Δ | ○ | ○ |
| Example D5 | 5% | 0.05 | ○ | ○ | Δ | ○ | ○ |
| Example D6 | 5% | 0.2 | ○ | ○ | ○ | ○ | ○ |
| Example D7 | 10% | 0.06 | ○ | ○ | Δ | ○ | ○ |
| Example D8 | 20% | 0.06 | ○ | ○ | X | ○ | ○ |
| Example D9 | 5% | 0.03 | ○ | X | Δ | ○ | ○ |
| Example D10 | 5% | 0.35 | ○ | ○ | ○ | ○ | X |
| Example D11 | 20% | 0.06 | ○ | ○ | X | ○ | ○ |
| Comparative Example D1 | 0% | 0.06 | ○ | X | — | — | ○ |

*1: The addition amount of modifying agent is the percentage of addition amount based on the total amount of the modifying agent and the polyvinylpyrrolidone resin (K-90, manufactured by ISP Ltd.).

Fifth Aspect of Invention

Example E1

A 6 μm-thick polyethylene terephthalate (PET) film (DIAFOIL K 203 E, manufactured by Mitsubishi Polyester Film Co., Ltd.) subjected to easy-adhesion treatment was provided as a substrate. A liquid composition E having the following composition for an adhesive layer was gravure coated onto the easy-adhesion treated face in the PET film at a coverage of 0.2 g/m$^2$ on a dry basis, and the coating was dried to form an adhesive layer. A liquid composition E(i) having the following composition for a dye layer was then gravure coated on the adhesive layer at a coverage of 0.8 g/m$^2$ on a dry basis, and the coating was dried to form a dye layer. Thus, a thermal transfer sheet of Example E1 was prepared. In this case, a liquid composition E having the following composition for a heat-resistant slip layer was previously gravure coated on the other side of the substrate at a coverage of 1.0 g/m$^2$ on a dry basis, and the coating was dried to form a heat resistant slip layer.

| | |
|---|---|
| <Liquid composition E for adhesive layer> | |
| Polyvinylpyrrolidone resin (K-90, manufactured by ISP Ltd.) | 5 parts |
| Polyurethane resin (SANPRENE IB-114B, manufactured by Sanyo Chemical Industries, Ltd.) | 0.5 part |
| Isocyanate (Takenate A-14, manufactured by MITSUI TAKEDA CHEMICALS, INC. | 0.15 part |
| Methyl ethyl ketone | 47.3 parts |
| Isopropyl alcohol | 47.3 parts |
| <Liquid composition E(i) for dye layer> | |
| C.I. Disperse Yellow 201 | 5.0 parts |
| Polyvinyl acetal resin (S-lec KS-5, manufactured by Sekisui Chemical Co., Ltd.) | 3.0 parts |
| Methyl ethyl ketone | 23.0 parts |
| Toluene | 69.0 parts |
| <Liquid composition E(ii) for dye layer> | |
| C.I. Disperse Violet 26 | 3.0 parts |
| Polyvinyl acetal resin (S-lec KS-5, manufactured by Sekisui Chemical Co., Ltd.) | 3.0 parts |
| Methyl ethyl ketone | 23.5 parts |
| Toluene | 70.5 parts |
| <Liquid composition E(iii) for dye layer> | |
| C.I. Sovlent Blue 22 | 5.0 parts |
| Polyvinyl acetal resin (S-lec KS-5, manufactured by Sekisui Chemical Co., Ltd.) | 3.0 parts |
| Methyl ethyl ketone | 23.0 parts |
| Toluene | 69.0 parts |
| <Liquid composition E for heat resistant slip layer> | |
| Polyvinyl butyral resin (S-lec BX-1, manufactured by Sekisui Chemical Co., Ltd.) | 13.6 parts |
| Polyisocyanate curing agent (Takenate D 218, manufactured by Takeda Chemical Industries, Ltd.) | 0.6 part |
| Phosphoric ester (Plysurf A 208 S, manufactured by Dai-Ichi Kogyo Seiyaku Co., Ltd.) | 0.8 part |
| Methyl ethyl ketone | 42.5 parts |
| Toluene | 42.5 parts |

Examples E2 to E6 and Comparative Examples E1 to E3

Thermal transfer sheets were prepared in the same manner as in Example E1, except that coating liquids prepared according to formulations shown in Table 5 were used as the coating liquid E for an adhesive layer.

Evaluation Test E (Evaluation of Transferred Image Density)

The thermal transfer sheets prepared in Example E and Comparative Example E were used in combination with an image receiving sheet (KL36-IP, manufactured by Canon Inc.), and printing was carried out with Card Photo Printer CP-200 manufactured by Canon Inc. The maximum density (cyan) in the printed portion was measured with a Macbeth densitometer RD-918, manufactured by Sakata INX Corp. The thermal transfer sheet was patched to a cyan panel part in genuine media, and a cyan blotted image (gradation value 255/255: density max) print pattern was printed. The printing was carried out under an environment of temperature 30° C. and humidity 50%. In the evaluation, the maximum density was compared with that of the reference ribbon (a ribbon in which any adhesive layer is not interposed (Comparative Example E1)), and the results were rated as follows.

Evaluation Criteria

◎: density of not less than 110%.

○: density of not less than 105% and less than 110%

(Suitability for Printing)

Printing was carried out under the following conditions for evaluation of suitability for printing.

The thermal transfer sheet and the image receiving sheet as used in the evaluation of transferred image density were provided. The thermal transfer sheet was patched to yellow, magenta, and cyan panel parts in genuine media, and a black blotted image (gradation value 255/255: density max) print pattern was printed and was evaluated, and the results were rated according to the following criteria. After storage of the thermal transfer sheet and the image receiving sheet under an environment of temperature 40° C. and humidity 90% for two weeks, the printing was carried out under two environments, that is, under an environment of temperature 30° C. and humidity 500% and under an environment of temperature 40° C. and humidity 90%.

<Evaluation Criteria for Suitability for Printing>

○: Defective printing phenomena such as abnormal transfer, uneven transfer, and omission of transfer did not occur for all the thermal transfer sheets patched respectively to the yellow, magenta, and cyan panel parts.

Δ ○: Defective printing phenomena such as abnormal transfer, uneven transfer, and omission of transfer occurred for one of the three patched thermal transfer sheets (for the thermal transfer sheet patched to the cyan panel part).

Δ: Defective printing phenomena such as abnormal transfer, uneven transfer, and omission of transfer occurred for two of the three patched thermal transfer sheets (for the thermal transfer sheets patched respectively to the magenta panel part and the cyan panel part).

x: Defective printing phenomena such as abnormal transfer, uneven transfer, and omission of transfer occurred for all the three patched thermal transfer sheets.

The evaluation results for each item are shown in Table 5 below.

TABLE 5

| Formulating materials | Manufacturer | Grade | Example E 1 | 2 | 3 | 4 | 5 | 6 | Comparative Example E 1 | 2 | 3 |
|---|---|---|---|---|---|---|---|---|---|---|---|
| Polyvinylpyrrolidone | ISP (Japan) Ltd. | K-90 | 100 | 100 | 100 | 100 | 100 | 100 | 100 | 100 | 100 |
| Polyurethane resin | Sanyo Chemical Industries, Ltd. | SANPRENE IB-114B | 10 | 10 | 10 | | | | | 10 | |
| Acrylic polyol resin | Dainippon Ink and Chemicals, Inc. | Acryclic A-801-P | | | | 10 | 10 | 10 | | | 10 |
| Isocyanate | MITSUI TAKEDA CHEMICALS, INC. | Takenate A-14 | 3 | | | 3 | | | | | |
| Blocked isocyanate | Nicca Chemical Co., Ltd. | NK ASSIST IS-80D | | 3 | | | 3 | | | | |
| Alminum chelate | Dainippon Ink and Chemicals, Inc. | DICNATE AL500 | | | 1 | | | 1 | | | |
| Evaluation | Transferred image density | | ◎ | ◎ | ◎ | ◎ | ◎ | ◎ | ◎ | ◎ | ◎ |
| Evaluation | Suitability for printing | | ○ | ○ | ○ | ○ | ○ | ○ | X | ○Δ | Δ |

The invention claimed is:

1. A thermal transfer sheet comprising: a substrate; a heat resistant slip layer; an adhesive layer; and a dye layer, wherein said heat resistant slip layer is provided on one side of said substrate, said adhesive layer and said dye layer are provided in that order on the other side of said substrate, and said adhesive layer comprises a modified polyvinylpyrrolidone resin that is a copolymer of an N-vinylpyrrolidone monomer with a vinyl polymerizable monomer.

2. The thermal transfer sheet according to claim 1, wherein the content of said modified polyvinylpyrrolidone resin in the adhesive layer is 10% by weight to 50% by weight based on the total solid content of the component(s) constituting the adhesive layer.

3. The thermal transfer sheet according to claim 1, wherein the coverage of the component(s) constituting the adhesive layer is 0.01 to 0.3 g/m$^2$ on a dry basis of the adhesive layer.

4. A thermal transfer sheet comprising: a substrate; a heat resistant slip layer; an adhesive layer; and a dye layer, wherein said heat resistant slip layer is provided on one side of said substrate, said adhesive layer and said dye layer are provided in that order on the other side of said substrate, and said adhesive layer comprises a polyvinylpyrrolidone resin and a saccharide or a sugar alcohol.

5. The thermal transfer sheet according to claim 4, wherein the content of said saccharide or sugar alcohol in said adhesive layer is 5% by weight to 10% by weight based on the total solid content of the components constituting the adhesive layer.

6. The thermal transfer sheet according to claim 4, wherein the coverage of the component(s) constituting the adhesive layer is 0.05 to 0.3 g/m$^2$ on a dry basis of the adhesive layer.

7. A thermal transfer sheet comprising: a substrate; a heat resistant slip layer; an adhesive layer; and a dye layer, wherein said heat resistant slip layer is provided on one side of said substrate, said adhesive layer and said dye layer are provided in that order on the other side of said substrate, and said adhesive layer comprises a polyvinylpyrrolidone resin and a complex forming agent.

8. The thermal transfer sheet according to claim 7, wherein the content of said complex forming agent is 0.5% by weight to 10% by weight based on the total solid content of the components constituting the adhesive layer.

9. The thermal transfer sheet according to claim 7, wherein the coverage of the component(s) constituting the adhesive layer is 0.05 to 0.3 g/m$^2$ on a dry basis of the adhesive layer.

10. A thermal transfer sheet comprising: a substrate; a heat resistant slip layer; an adhesive layer; and a dye layer, wherein said heat resistant slip layer is provided on one side of said substrate, said adhesive layer and said dye layer are provided in that order on the other side of said substrate, and said adhesive layer comprises a polyvinylpyrrolidone resin and a modifying agent for modifying said resin, wherein said modifying agent is at least one of carboxylmethylcellulose, cellulose acetate, cellulose acetate propionate, dibutyl tartrate, dimethyl phthalate and shellac resins.

11. The thermal transfer sheet according to claim 10, wherein the content of said modifying agent is 0.5% by weight to 10% by weight based on the total solid content of the components constituting the adhesive layer.

12. The thermal transfer sheet according to claim 10, wherein the coverage of the components constituting the adhesive layer is 0.05 to 0.3 g/m$^2$ on a dry basis of the adhesive layer.

13. A thermal transfer sheet comprising: a substrate; and an adhesive layer and a dye layer provided in that order on at least one side of the substrate, wherein said adhesive layer comprises a polyvinylpyrrolidone resin, (A) at least one component selected from the group consisting of polyurethane resins and acrylic polyol resins that are soluble in a mixed solvent composed of methyl ethyl ketone and isopropyl alcohol at a weight ratio of 1:1 and, even when diluted to a solid content of 5% by weight, do not gel, and (B) at least one component selected from the group consisting of isocyanates, blocked isocyanates, and aluminum chelating agents that are soluble in a mixed solvent composed of methyl ethyl ketone and isopropyl alcohol at a weight ratio of 1:1 and, even when diluted to a solid content of 5% by weight, do not gel.

14. The thermal transfer sheet according to claim 13, wherein said adhesive layer further comprises a modification product of a polyvinylpyrrolidone resin.

15. The thermal transfer sheet according to claim 13, wherein the content of at least one component selected from said group (A) in said adhesive layer is 1% by weight to 30% by weight based on the total solid content of the components constituting the adhesive layer, and the content of at least one component selected from said group (B) in said adhesive layer is 1% by weight to 10% by weight based on the total solid content of the components constituting the adhesive layer.

16. The thermal transfer sheet according to claim 13, wherein the coverage of the components constituting the adhesive layer is 0.01 to 3.0 $g/m^2$ on a dry basis of the adhesive layer.

* * * * *

UNITED STATES PATENT AND TRADEMARK OFFICE

CERTIFICATE OF CORRECTION

PATENT NO. : 7,642,219 B2
APPLICATION NO. : 10/586171
DATED : January 5, 2010
INVENTOR(S) : Tsuaki Odaka et al.

It is certified that error appears in the above-identified patent and that said Letters Patent is hereby corrected as shown below:

Column 55

Delete claims 1-3.

Signed and Sealed this

Thirtieth Day of March, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,642,219 B2
APPLICATION NO. : 10/586171
DATED : January 5, 2010
INVENTOR(S) : Tsuaki Odaka et al.

It is certified that error appears in the above-identified patent and that said Letters Patent is hereby corrected as shown below:

Delete the title page and substitute therefore the attached title page showing corrected number of claims in patent.

Columns 55 and 56

Delete claims 1-16 and substitute therefore the attached corrected claims 1-13.

This certificate supersedes the Certificate of Correction issued March 30, 2010.

Signed and Sealed this

Day of , 2009

David J. Kappos

David J. Kappos
*Director of the United States Patent and Trademark Office*

(12) United States Patent
Odaka et al.

(10) Patent No.: US 7,642,219 B2
(45) Date of Patent: Jan. 5, 2010

(54) THERMAL TRANSFER SHEET

(75) Inventors: Tsuaki Odaka, Shinjuku-Ku (JP); Munenori Ieshige, Shinjuku-Ku (JP); Mitsuru Maeda, Shinjuku-Ku (JP); Kenichi Hirota, Shinjuku-Ku (JP); Masahiro Yuki, Shinjuku-Ku (JP)

(73) Assignee: Dai Nippon Printing Co., Ltd., Shinjuku-Ku (JP)

( * ) Notice: Subject to any disclaimer, the term of this patent is extended or adjusted under 35 U.S.C. 154(b) by 179 days.

(21) Appl. No.: 10/586,171

(22) PCT Filed: Jan. 20, 2005

(86) PCT No.: PCT/JP2005/000700

§ 371 (c)(1),
(2), (4) Date: Jul. 17, 2006

(87) PCT Pub. No.: WO2005/068210

PCT Pub. Date: Jul. 28, 2005

(65) Prior Publication Data

US 2008/0069982 A1 Mar. 20, 2008

(30) Foreign Application Priority Data

| | | |
|---|---|---|
| Jan. 20, 2004 | (JP) | 2004-011610 |
| Mar. 1, 2004 | (JP) | 2004-055681 |
| Mar. 1, 2004 | (JP) | 2004-055682 |
| Mar. 12, 2004 | (JP) | 2004-070969 |
| Mar. 25, 2004 | (JP) | 2004-089716 |

(51) Int. Cl.
*B41M 5/50* (2006.01)
*B41M 5/42* (2006.01)

(52) U.S. Cl. ..... 503/227; 428/32.81

(58) Field of Classification Search ..... None
See application file for complete search history.

(56) References Cited

U.S. PATENT DOCUMENTS

| | | | |
|---|---|---|---|
| 3,216,983 | A | 11/1965 | Shelanski et al. |
| 5,106,217 | A | 4/1992 | Mecke et al |
| 5,147,843 | A | 9/1992 | Bodem et al. |
| 5,306,691 | A | 4/1994 | Bauer et al. |
| 2003/0181331 | A1 | 9/2003 | Ieshige et al. |

FOREIGN PATENT DOCUMENTS

| | | | |
|---|---|---|---|
| JP | 02-074375 | A1 | 3/1990 |
| JP | 05-131760 | A1 | 5/1993 |
| JP | 07-179072 | A1 | 7/1995 |
| JP | 2002-274046 | A1 | 9/2002 |
| JP | 2003-312151 | | 11/2003 |
| JP | 2003-312151 | A1 | 11/2003 |
| JP | 2004-074766 | A1 | 3/2004 |

*Primary Examiner*—Bruce H Hess
(74) *Attorney, Agent, or Firm*—Burr & Brown

(57) ABSTRACT

Disclosed is a thermal transfer sheet that can meet demands for increased printing speed in thermal transfer, higher density of thermally transferred images, and higher quality. The thermal transfer sheet comprises a substrate and an adhesive layer and a dye layer provided in that order on one side of the substrate, wherein the adhesive layer comprises a polyvinylpyrrolidone resin and a composition for suppressing hygroscopic properties of the polyvinylpyrrolidone resin.

13 Claims, 1 Drawing Sheet

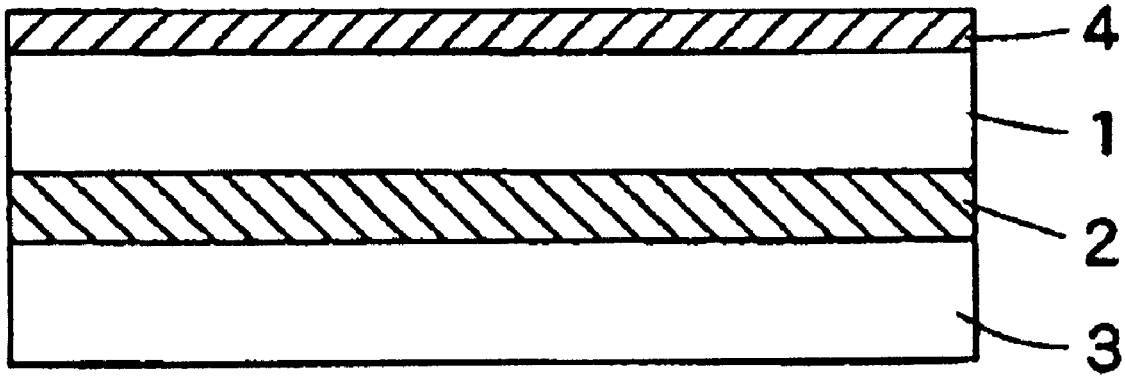

1. A thermal transfer sheet comprising: a substrate; a heat resistant slip layer; an adhesive layer; and a dye layer, wherein said heat resistant slip layer is provided on one side of said substrate, said adhesive layer and said dye layer are provided in that order on the other side of said substrate, and said adhesive layer comprises a polyvinylpyrrolidone resin and a saccharide or a sugar alcohol.

2. The thermal transfer sheet according to claim 1, wherein the content of said saccharide or sugar alcohol in said adhesive layer is 5% by weight to 10% by weight based on the total solid content of the components constituting the adhesive layer.

3. The thermal transfer sheet according to claim 1, wherein the coverage of the component(s) constituting the adhesive layer is 0.05 to 0.3 $g/m^2$ on a dry basis of the adhesive layer.

4. A thermal transfer sheet comprising: a substrate; a heat resistant slip layer; an adhesive layer; and a dye layer, wherein said heat resistant slip layer is provided on one side of said substrate, said adhesive layer and said dye layer are provided in that order on the other side of said substrate, and said adhesive layer comprises a polyvinylpyrrolidone resin and a complex forming agent.

5. The thermal transfer sheet according to claim 4, wherein the content of said complex forming agent is 0.5% by weight to 10% by weight based on the total solid content of the components constituting the adhesive layer.

6. The thermal transfer sheet according to claim 4,
wherein the coverage of the component(s) constituting the adhesive layer is 0.05 to 0.3 $g/m^2$ on a dry basis of the adhesive layer.

7. A thermal transfer sheet comprising: a substrate; a heat resistant slip layer; an adhesive layer; and a dye layer, wherein said heat resistant slip layer is provided on one side of said substrate, said adhesive layer and said dye layer are provided in that order on the other side of said substrate, and said adhesive layer comprises a polyvinylpyrrolidone resin and a modifying agent for modifying said resin, wherein said modifying agent is at least one of carboxylmethylcellulose, cellulose acetate, cellulose acetate propionate, dibutyl tartrate, dimethyl phthalate and shellac resins.

8. The thermal transfer sheet according to claim 7,
wherein the content of said modifying agent is 0.5% by weight to 10% by weight based on the total solid content of the components constituting the adhesive layer.

9. The thermal transfer sheet according to claim 7,
wherein the coverage of the components constituting the adhesive layer is 0.05 to 0.3 $g/m^2$ on a dry basis of the adhesive layer.

10. A thermal transfer sheet comprising: a substrate; and an adhesive layer and a dye layer provided in that order on at least one side of the substrate, wherein said adhesive layer comprises a polyvinylpyrrolidone resin, (A) at least one component selected from the group consisting of polyurethane resins and acrylic polyol resins that are soluble in a mixed solvent composed of methyl ethyl ketone and isopropyl alcohol at a weight ratio of 1 : 1 and, even when diluted to a solid content of 5% by weight, do not gel, and (B) at least one component selected from the group consisting of isocyanates, blocked isocyanates, and aluminum chelating agents that are soluble in a mixed solvent composed of methyl ethyl ketone and isopropyl alcohol at a weight ratio of 1 : 1 and, even when diluted to a solid content of 5% by weight, do not gel.

11. The thermal transfer sheet according to claim 10, wherein said adhesive layer further comprises a modification product of a polyvinylpyrrolidone resin.

12. The thermal transfer sheet according to claim 10, wherein the content of at least one component selected from said group (A) in said adhesive layer is 1% by weight to 30% by weight based on the total solid content of the components constituting the adhesive layer, and the content of at least one component selected from said group (B) in said adhesive layer is 1% by weight to 10% by weight based on the total solid content of the components constituting the adhesive layer.

13. The thermal transfer sheet according to claim 10, wherein the coverage of the components constituting the adhesive layer is 0.01 to 3.0 $g/m^2$ on a dry basis of the adhesive layer.

Signed and Sealed this

Twentieth Day of April, 2010

David J. Kappos

David J. Kappos
*Director of the United States Patent and Trademark Office*